US007625070B2

(12) United States Patent
Kojima

(10) Patent No.: US 7,625,070 B2
(45) Date of Patent: Dec. 1, 2009

(54) LIQUID EJECTION HEAD AND IMAGE FORMING APPARATUS

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 360 days.

(21) Appl. No.: 11/239,302

(22) Filed: Sep. 30, 2005

(65) Prior Publication Data

US 2006/0250455 A1 Nov. 9, 2006

(30) Foreign Application Priority Data

Sep. 30, 2004 (JP) ..... 2004-286022

(51) Int. Cl.
*B41J 2/05* (2006.01)
*B41J 2/045* (2006.01)

(52) U.S. Cl. ..... 347/58; 347/68

(58) Field of Classification Search ..... 347/68–72, 347/50, 58; 310/311, 324, 330, 331, 358, 310/365, 366
See application file for complete search history.

(56) References Cited

U.S. PATENT DOCUMENTS

| | | | | |
|---|---|---|---|---|
| 4,072,959 | A | 2/1978 | Elmqvist | |
| 4,520,374 | A * | 5/1985 | Koto | 347/48 |
| 5,940,099 | A | 8/1999 | Karlinski | |
| 6,439,702 | B1 | 8/2002 | Karlinski | |
| 6,481,074 | B1 | 11/2002 | Karlinski | |
| 6,488,355 | B2 * | 12/2002 | Nakamura et al. | 347/40 |
| 6,491,384 | B2 * | 12/2002 | Usui et al. | 347/70 |
| 6,568,797 | B2 * | 5/2003 | Yamauchi et al. | 347/70 |
| 6,616,270 | B1 | 9/2003 | Miyata et al. | |
| 6,766,567 | B2 | 7/2004 | Karlinski | |
| 7,506,970 | B2 * | 3/2009 | Mita | 347/68 |
| 2002/0001015 | A1 * | 1/2002 | Kojima et al. | 347/47 |
| 2003/0088969 | A1 | 5/2003 | Karlinski | |
| 2003/0206218 | A1 | 11/2003 | Miyata et al. | |
| 2003/0227519 | A1 * | 12/2003 | Ikeda et al. | 347/68 |
| 2004/0001122 | A1 * | 1/2004 | Miyata | 347/68 |

FOREIGN PATENT DOCUMENTS

| | | | |
|---|---|---|---|
| JP | 60-8953 | B2 | 3/1985 |
| JP | 1-130950 | A | 5/1989 |

(Continued)

*Primary Examiner*—Stephen D Meier
*Assistant Examiner*—Geoffrey Mruk
(74) *Attorney, Agent, or Firm*—Birch, Stewart, Kolasch & Birch, LLP.

(57) ABSTRACT

The liquid ejection head including: a plurality of ejection ports which eject liquid to a recording medium; a plurality of pressure chambers which are connected respectively to the ejection ports; a plurality of piezoelectric elements which respectively deform the pressure chambers and are provided on a side of the pressure chambers opposite to a side on which the ejection ports are formed; a common liquid chamber which is provided on the side of the pressure chambers opposite to the side on which the ejection ports are formed; and a plurality of wiring members which are formed in such a manner that at least a portion thereof rises upward through the common liquid chamber in a substantially perpendicular direction with respect to a surface on which the piezoelectric elements are disposed, each of the wiring members containing driving wires through which driving signals are applied respectively to at least two of the piezoelectric elements.

15 Claims, 22 Drawing Sheets

FOREIGN PATENT DOCUMENTS

| | | | | |
|---|---|---|---|---|
| JP | 9-226114 | A | | 9/1997 |
| JP | 11-235819 | A | | 8/1999 |
| JP | 11291496 | A | * | 10/1999 |
| JP | 2000-127379 | A | | 5/2000 |
| JP | 2000-289201 | A | | 10/2000 |
| JP | 2001-179973 | A | | 7/2001 |
| JP | 2003-512211 | A | | 4/2003 |
| JP | 2003-182069 | A | | 7/2003 |

* cited by examiner

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to wiring technology for the driving wires of piezoelectric elements provided in a liquid ejection head.

2. Description of the Related Art

An inkjet type image forming apparatus has a print head in which a plurality of nozzles (ejection ports) are arranged in the form of a matrix, and it forms an image on a recording medium by ejecting ink droplets from the nozzles onto the recording medium.

In a print head of the related art, as shown in FIG. 28, ink is supplied to a pressure chamber 52 from a common liquid chamber 55 disposed on the same side of the pressure chamber 52 as the side where the nozzle 51 is formed in the pressure chamber 52. When an electrical signal corresponding to the image data is supplied to a piezoelectric element 58 located on a diaphragm 56, the diaphragm 56 is deformed by the driving of the piezoelectric element 58. Consequently, the volume of the pressure chamber 52 is reduced, an ink droplet is ejected from the nozzle 51, and this ink droplet lands on a recording medium, thereby forming a dot on the recording medium. By combining dots of this kind, an image is formed on the recording medium.

In recent years, there have been demands for improved image quality in image forming apparatuses. In order to achieve higher image quality, it is necessary to arrange the nozzles of the print head at high density, thereby obtaining a high number of pixels per image. Therefore, various technologies have been proposed with the aim of increasing nozzle density (see, for example, Japanese Patent Application Publication Nos. 9-226114; 2001-179973, 2000-127379, 2000-289201 and 2003-512211).

Japanese Patent Application Publication No. 9-226114 discloses a print head in which piezoelectric elements are disposed on a diaphragm which forms the ceiling of pressure chambers, a reservoir (common liquid chamber) is provided on the side of the diaphragm adjacent to the piezoelectric elements, and holes for supplying ink are provided in the diaphragm.

Japanese Patent Application Publication No. 2001-179973 discloses a print head in which piezoelectric bodies (piezoelectric elements) are disposed on a diaphragm which forms the ceiling of pressure chambers, and an ink supply tank (common liquid chamber) is provided on top of the piezoelectric bodies, via a partition.

Japanese Patent Application Publication No. 2000-127379 discloses a print head in which a reservoir (common liquid chamber) is formed on the same side as piezoelectric elements, which are disposed on the opposite surface of pressure generating chambers (pressure chambers) from the nozzle side.

Japanese Patent Application Publication No. 2000-289201 discloses a print head in which piezoelectric actuators (piezoelectric elements) and a common ink chamber (common liquid chamber) are disposed on the same side of pressure chambers as the nozzles, and a substrate (wiring layer) is disposed on the opposite surface of the pressure chambers to the nozzles.

Japanese Patent Application Publication No. 2003-512211 discloses a print head in which an ink supply layer formed by a porous member for supplying ink to pressure chambers is disposed between a nozzle layer in which nozzles are formed, and a cavity layer formed with ink cavities (pressure chambers). According to this patent, piezoelectric elements are disposed on a displacement plate (diaphragm) which constitutes the ceiling of the ink cavities, wiring members are provided from the piezoelectric elements in a substantially perpendicular direction with respect to the nozzle surface, and a substrate (wiring layer) is disposed at the ends of these wiring members.

In the print head shown in FIG. 28, the supply ports (flow channels) which connect the common liquid chamber with the pressure chambers have a complex structure, and if ink of high-viscosity is used, then refilling characteristics in respect of the supply of ink to the pressure chambers after ejection of ink are poor.

In the print heads disclosed in Japanese Patent Application Publication Nos. 9-226114 and 2001-179973, since the driving wires for the piezoelectric elements are located on the diaphragm, it is not possible to ensure sufficient space for the driving wires, and it becomes difficult to dispose the nozzles at high density.

In the print head disclosed in Japanese Patent Application Publication No. 2000-127379, the driving wires to the piezoelectric elements are formed by wire bonding or film deposition, and they are connected to external wires installed above the common liquid chamber. However, since the driving wires are formed externally to the common liquid chamber, it is difficult to ensure space for the driving wires of the piezoelectric elements, and hence there are restrictions on the size of the common liquid chamber. If the common liquid chamber is small in size, then ink supply to the pressure chambers cannot meet demand, and it becomes difficult to drive the nozzles at high frequency. Furthermore, the print head disclosed in Japanese Patent Application Publication No. 2000-127379 only contemplates the composition of a print head having one nozzle row, and it is not suitable for a composition in which a plurality of nozzles are arranged at high density.

In Japanese Patent Application Publication No. 2000-289201, driving wires (aluminum plugs) connecting the piezoelectric elements with the wiring layer are formed in such a manner that they pass through a laminated plate between the piezoelectric elements and the wiring layer, which are disposed in such a manner that the pressure chambers are sandwiched therebetween. Therefore, it is difficult to ensure sufficient space for the driving wires, and hence the nozzles cannot be formed to high density.

In the print head disclosed in Japanese Patent Application Publication No. 2003-512211, a common liquid chamber (ink manifold) for accumulating ink to be supplied to the ink supply layer is provided on the opposite side of the wiring layer with respect to the wiring layer. Therefore, the flow channel for supplying ink to the pressure chambers from the common liquid chamber and via the ink supply layer is long, the supply of ink from the common liquid chamber to the pressure chambers is not sufficiently rapid, and it is difficult to form the nozzles at a high density. Moreover, if the nozzles are driven at high density, the ink supply will not be able to keep up with demand. Moreover, since the ink supply layer is constituted by a porous member, the print head is not suitable for ejection of high-viscosity ink.

SUMMARY OF THE INVENTION

The present invention has been contrived in view of the foregoing circumstances, and it provides a liquid ejection head and an image forming apparatus whereby the flow channel resistance with respect to liquid accumulated in a common liquid chamber is reduced, and ejection of high-viscosity ink becomes possible.

In order to attain the aforementioned object, the present invention is directed to a liquid ejection head, comprising: a plurality of ejection ports which eject liquid to a recording medium; a plurality of pressure chambers which are connected respectively to the ejection ports; a plurality of piezoelectric elements which respectively deform the pressure chambers and are provided on a side of the pressure chambers opposite to a side on which the ejection ports are formed; a common liquid chamber which is provided on the side of the pressure chambers opposite to the side on which the ejection ports are formed; and a plurality of wiring members which are formed in such a manner that at least a portion thereof rises upward through the common liquid chamber in a substantially perpendicular direction with respect to a surface on which the piezoelectric elements are disposed, each of the wiring members containing driving wires through which driving signals are applied respectively to at least two of the piezoelectric elements.

According to the present invention, the wiring members contain driving wires for a plurality of piezoelectric elements, and therefore, the surface area occupied by the wiring members inside the common liquid chamber is reduced, and the flow resistance with respect to the liquid accumulated in the common liquid chamber is lowered. Consequently, ink refill characteristics are good and ejection of high-viscosity ink becomes possible.

Furthermore, it is possible to reduce the restrictions for ensuring the space for the driving wires of the piezoelectric elements, and therefore, high density of the ejection ports (nozzles) can be achieved. Moreover, the number of wiring members is reduced, and hence the reliability of the connecting sections between the piezoelectric elements and the driving wires is improved.

The driving wires for the piezoelectric elements may include the individual electrode wires provided for respective piezoelectric elements and the common electrode wire (ground wire).

Preferably, the wiring members are formed in a shape of one of column and wall.

Wall-shaped wiring members are not restricted to a composition which makes contact with the wall sections of the common liquid chamber, and they may also be composed in an integrated fashion so as to be incorporated into the wall sections.

Preferably, the wiring members are formed so as to rise upward from the piezoelectric elements or vicinities of the piezoelectric elements.

According to the present invention, the density of the ejection ports (nozzles) can be increased.

Preferably, the ejection ports are arranged in a two-dimensional array; and the wiring members are arranged two-dimensionally on the surface on which the piezoelectric elements are disposed.

According to the present invention, it is possible to achieve an even higher density of the ejection ports (nozzles), and furthermore, space for positioning the wire members is ensured and the flow resistance inside the common liquid chamber is reduced.

Preferably, each of the wiring members contains the driving wires for the piezoelectric elements corresponding to at least two of the ejection ports arranged in a column direction having a prescribed non-perpendicular angle with respect to a width direction of the recording medium.

According to the present invention, since the ejection ports (nozzles) arranged in a column direction having a prescribed non-perpendicular angle with respect to the width direction of the recording medium have a low ratio of ejecting droplets simultaneously, in comparison with ejection ports (nozzles) arranged in the width direction (main scanning direction), then it is possible to reduce cross-talk in the wiring members which contain a plurality of driving wires.

Preferably, each of the wiring members contains the driving wires for the piezoelectric elements corresponding to all of the ejection ports arranged in the column direction.

According to the present invention, it is possible to reduce the cross-talk in the wiring members, and to reduce the number of wiring members, and therefore, the flow resistance with respect to the liquid accumulated inside the common liquid chamber can be lowered further.

Preferably, $Pn=(n+k)\times Pd$, where Pn is a pitch of the ejection ports in a sub-scanning direction substantially perpendicular to the width direction of the recording paper, Pd is a pitch of dots formed on the recording medium in the sub-scanning direction by droplets of the liquid ejected from the ejection ports, n is a natural number, and k is a coefficient of $0.4 \leqq k \leqq 0.6$.

According to the present invention, by arranging the ejection ports (nozzles) in such a manner that the ejection port pitch (nozzle pitch) Pn in the sub-scanning direction, and the dot pitch Pd in the sub-scanning direction on the recording medium satisfy the aforementioned equation, then ejection ports (nozzles) aligned in the column direction do not eject droplets simultaneously, and therefore, it is possible to reduce cross-talk in the wiring members which contain driving wires for the piezoelectric elements corresponding to the ejection ports.

Preferably, each of the wiring members comprises: individual electrode wires for the piezoelectric elements, the individual electrode wires being arranged in substantially central region of the each of the wiring members; and a common electrode wire for the piezoelectric elements, the common electrode wire being formed so as to surround perimeters of the individual electrode wires.

According to the present invention, by means of a dual structure comprising individual electrode wires and a common electrode wire surrounding these, good shielding characteristics are obtained, and noise resistance is improved.

Furthermore, desirably, the common electrode wiring is formed to a large thickness. In this case, the strength of the wiring members is increased, and the rigidity of the liquid ejection head is improved.

Preferably, a wiring density per unit cross-sectional area inside the wiring members is lower on a side adjacent to the piezoelectric elements.

According to the present invention, it is possible to ensure reliable electrical connections between the driving wires contained in the wiring members and the respective piezoelectric elements.

Preferably, the liquid ejection head further comprises: a plurality of determination devices which determine ejection failures at the ejection ports; and a determination wiring member which is formed in such a manner that at least a portion thereof rises upward through the common liquid chamber in a substantially perpendicular direction with respect to the surface on which the piezoelectric elements are disposed, the determination wiring member containing determination wires through which determination signals of the determination devices are outputted.

According to the present invention, by incorporating the driving wires of the piezoelectric elements and the determination wires of the determination device into different wiring members, the S/N ratio of the determination device is improved.

In order to attain the aforementioned object, the present invention is also directed to an image forming apparatus, comprising the above-described liquid ejection head.

According to the present invention, the wiring members contain driving wires for a plurality of piezoelectric elements, and therefore, the surface area occupied by the wiring members inside the common liquid chamber is reduced, and the flow resistance with respect to the liquid accumulated in the common liquid chamber is lowered. Consequently, ink refill characteristics are good and ejection of high-viscosity ink becomes possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
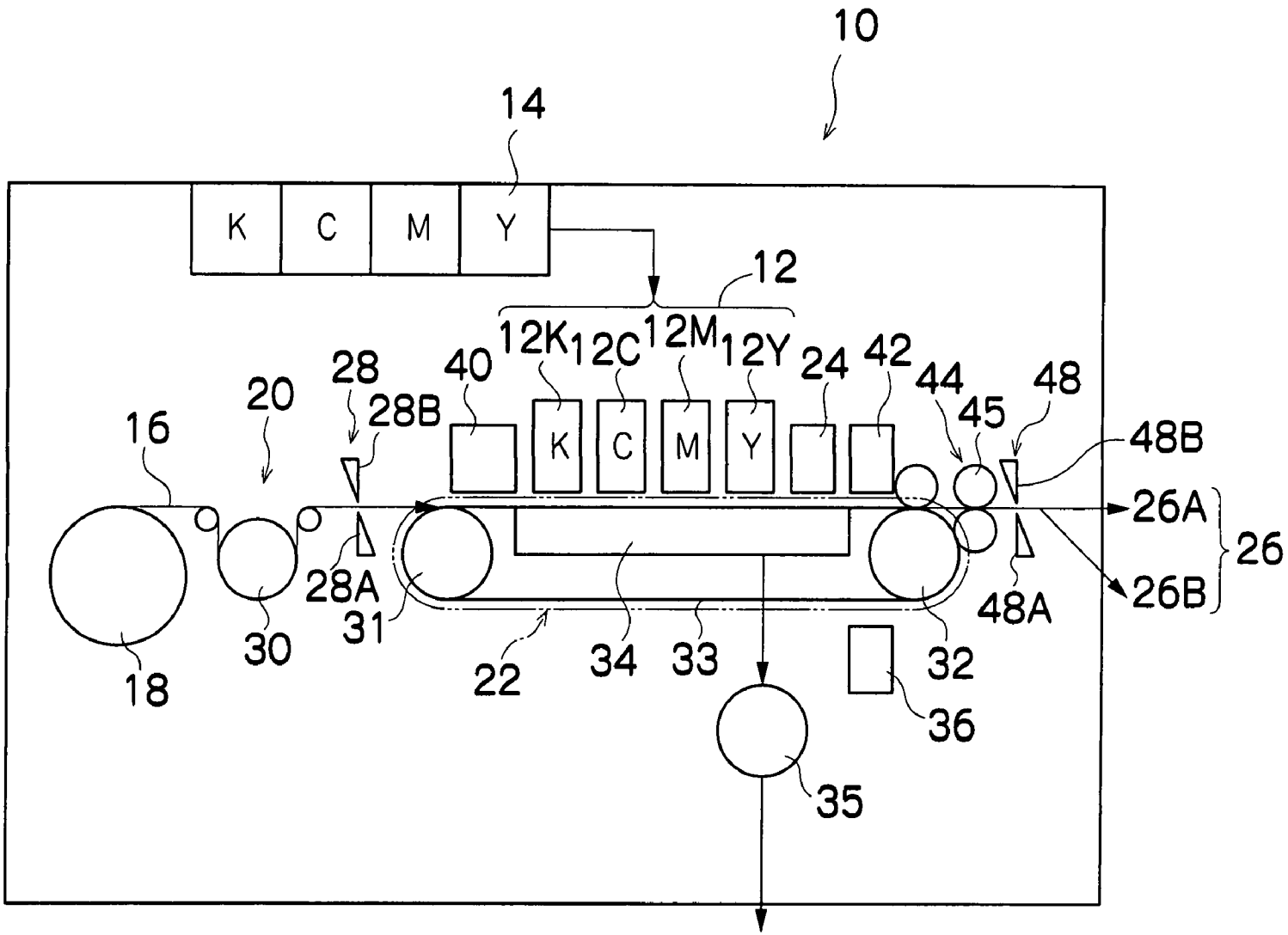
FIG. 1 is a general schematic drawing of one embodiment of an inkjet recording apparatus forming an image forming apparatus according to the present invention.

FIG. 1 is a general schematic drawing of an embodiment of an inkjet recording apparatus which forms an image forming apparatus according to the present invention. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
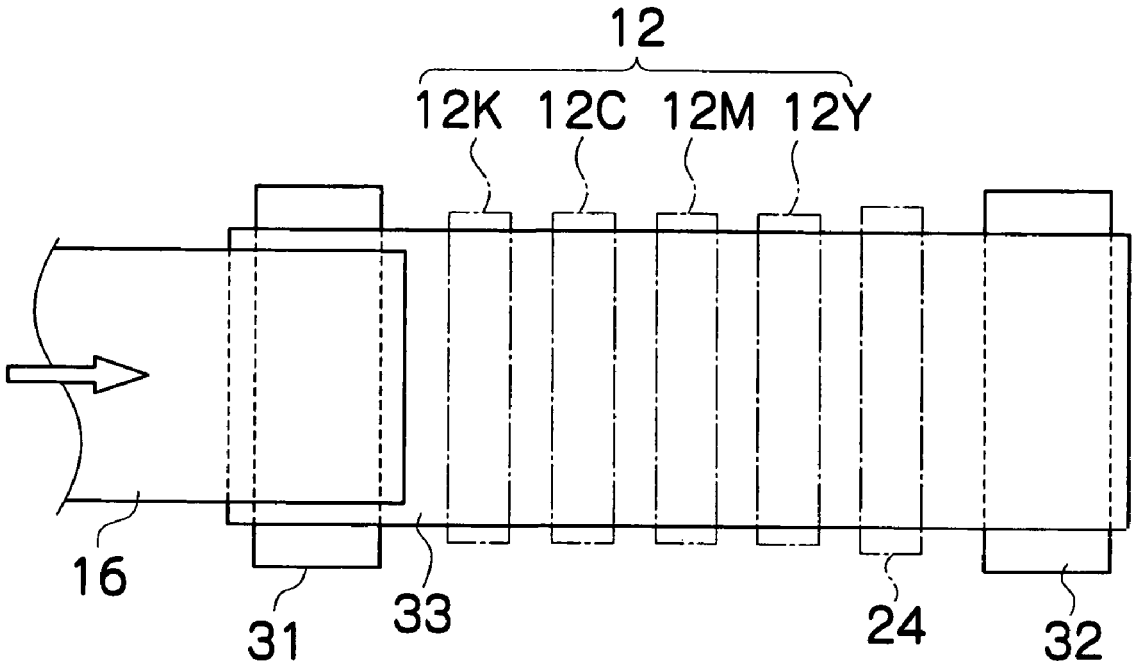
FIG. 2 is a plan view of the principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y which constitute the print unit 12 each comprise line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Although a configuration with the four standard colors, KCMY, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to each print head 12K, 12C, 12M, 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor (a line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collating and stacking the images according to job orders is provided in the paper output section 26A corresponding to the main images.

Figure 3:
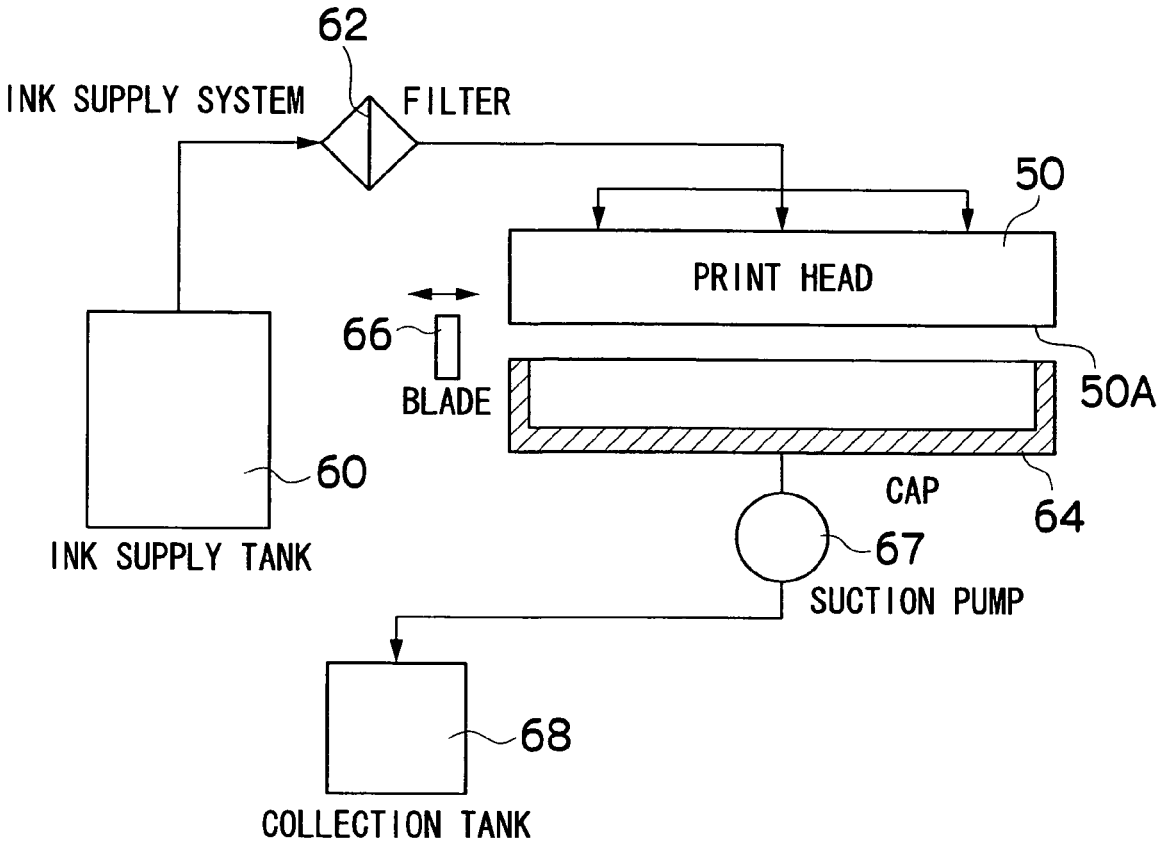
FIG. 3 is a schematic drawing showing the composition of an ink supply system in the inkjet recording apparatus.

The print heads 12K, 12C, 12M and 12Y provided for the respective ink colors have the same structure, and a reference numeral 50 is hereinafter designated to any of the print heads 12K, 12C, 12M and 12Y Composition of Ink Supply System FIG. 3 is a conceptual diagram showing the composition of an ink supply system in the inkjet recording apparatus 10. The ink supply tank 60 is a base tank for supplying ink to the print head 50, and this ink tank 60 is disposed in the ink storing and loading unit 14 shown in FIG. 1. The ink supply tank 60 may adopt a system for replenishing ink by means of a replenishing opening (not shown), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. The ink supply tank 60 in FIG. 3 is equivalent to the ink storing and loading unit 14 shown in FIG. 1 and described above.

As shown in FIG. 3, a filter 62 is provided between the ink supply tank 60 and the print head 50, in order to remove foreign matter and air bubbles. Desirably, the filter mesh size is equal to or less than the nozzle diameter. Although not shown in FIG. 3, desirably, a composition is adopted in which a subsidiary tank is provided in the vicinity of the print head 50, or in an integrated manner with the print head 50. The subsidiary tank has the function of improving damping effects and refilling, in order to prevent variations in the internal pressure inside the head.

Furthermore, the inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced upwards and downwards in a relative fashion with respect to the print head 50 by an elevator mechanism (not shown). When the power of the inkjet recording apparatus 10 is switched OFF or when in a print standby state, the cap 64 is raised to a predetermined raised position so as to come into close contact with the print head 50, and the nozzle face 50A is thereby covered with the cap 64.

The cleaning blade 66 is composed of rubber or another elastic member, and can slide on the nozzle surface 50A of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle has declined and the ink viscosity in the vicinity of the nozzle 51 has increased, then a preliminary ejection is performed onto the cap 64, in order to remove the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the ink removed by suction is sent to a recovery tank 68. This suction operation is also carried out in order to remove degraded ink having increased viscosity (hardened ink), when ink is loaded into the head for the first time, and when the print head 50 starts to be used after having been out of use for a long period of time.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element for driving ejection (not shown in FIG. 3 and indicated by reference numeral 58 in FIG. 7) is operated. Therefore, before reaching such a state, the piezoelectric element 58 is operated toward an ink receptacle (in a viscosity range that allows ejection by the operation of the piezoelectric element 58), and a preliminary ejection is performed which causes the ink in the vicinity of the nozzle of which viscosity has increased to be ejected. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased beyond a certain level, ink can no longer be ejected by means of a preliminary ejection, and hence a suctioning action is carried out as follows.

More specifically, when bubbles have become intermixed into the ink inside the nozzles 51 and the pressure chambers 52, ink can no longer be ejected from the nozzles even if the piezoelectric elements 58 are operated. In a case of this kind, a cap 64 is placed on the nozzle surface of the print head 50, and the ink containing air bubbles or the ink of increased viscosity inside the pressure chambers 52 is suctioned by a suction pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor.

Description of Control System

Figure 4:
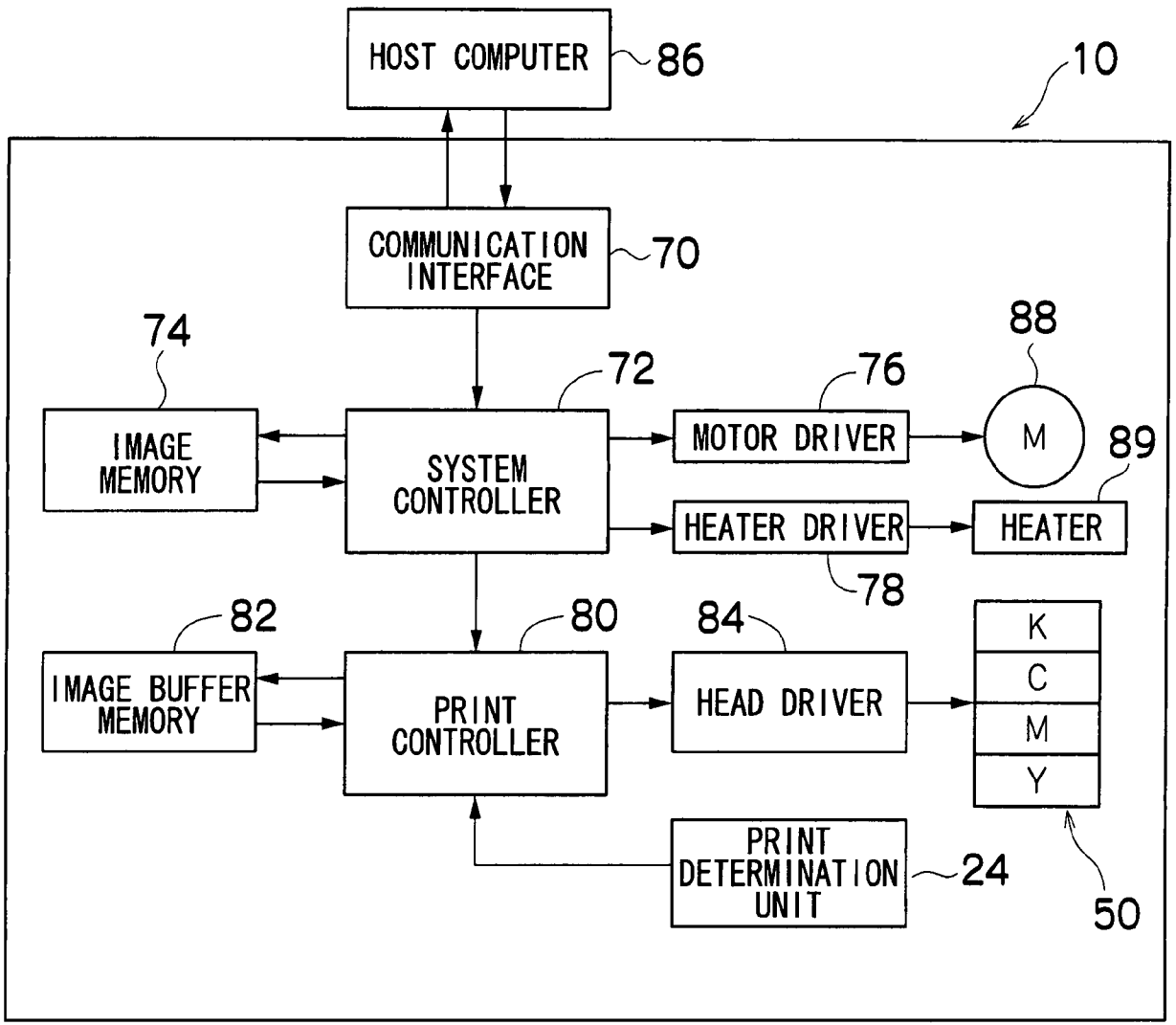
FIG. 4 is a principal block diagram showing the system composition of the inkjet recording apparatus.

FIG. 4 is a principal block diagram showing the system composition of the inkjet recording apparatus 10. The inkjet recording apparatus 10 comprises a communications interface 70, a system controller 72, an image memory 74, a motor driver 76, a heater driver 78, a print controller 80, an image buffer memory 82, a head driver 84, and the like.

The communications interface 70 is an interface unit for receiving image data transmitted by a host computer 86. For the communications interface 70, a serial interface, such as USB, IEEE 1394, the Ethernet, or a wireless network, or the like, or a parallel interface, such as a Centronics interface, or the like, can be used. It is also possible to install a buffer memory (not shown) for achieving high-speed communications. Image data sent from a host computer 86 is read into the inkjet recording apparatus 10 via the communications interface 70, and it is stored temporarily in the image memory 74. The image memory 74 is a storage device for temporarily storing an image input via the communications interface 70, and data is written to and read from the image memory 74 via the system controller 72. The image memory 74 is not limited to a memory composed of a semiconductor element, and a magnetic medium, such as a hard disk, or the like, may also be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (image data) thus generated to the head driver 84. Prescribed signal processing is carried out in the print controller 80, and the ejection amount and the ejection timing of the ink droplets from the print head 50 are controlled via the head driver 84, on the basis of the image data. By this means, prescribed dot size and dot positions can be achieved.

The image buffer memory 82 is provided in the print controller 80, and image data, parameters, and other data are temporarily stored in the image buffer memory 82 when image data is processed in the print controller 80. FIG. 4 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

The head driver 84 drives the piezoelectric elements 58 (not shown in FIG. 4, but shown in FIG. 7) of the respective colors, 12K, 12C, 12M, 12Y, on the basis of print data supplied by the print controller 80. A feedback control system for maintaining constant drive conditions for the print heads may be included in the head driver 84.

As shown in FIG. 1, the print determination unit 24 is a block including a line sensor (not shown), which reads in the image printed onto the recording paper 16, performs various signal processing operations, and the like, and determines the print situation (presence/absence of ejection, variation in droplet ejection, and the like). The print determination unit 24 supplies these detection results to the print controller 80.

According to requirements, the print controller 80 makes various corrections with respect to the print head 50 on the basis of information obtained from the print determination unit 24.

Structure of Print Head

Figure 5:
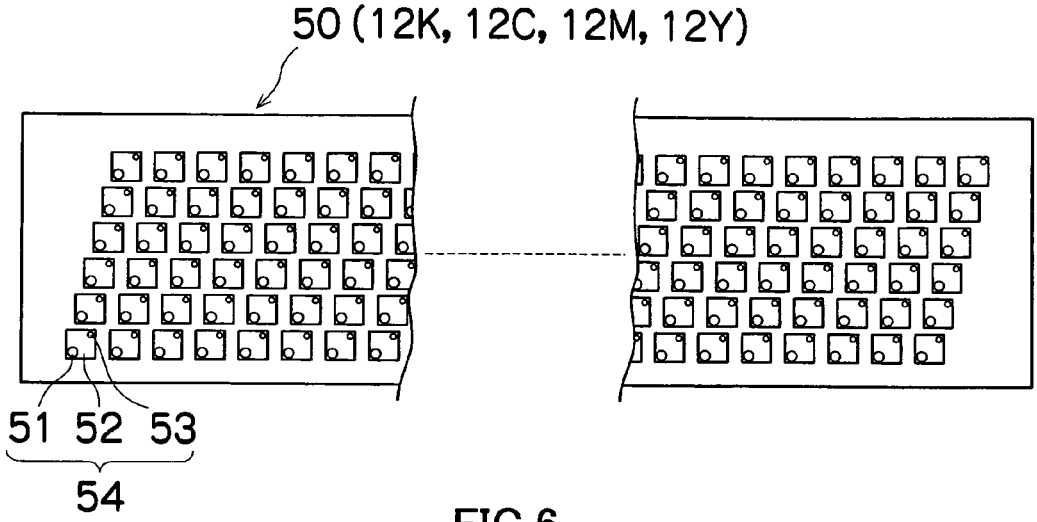
FIG. 5 is a plan view perspective diagram showing an example of the structure of the print head.
Figure 6:
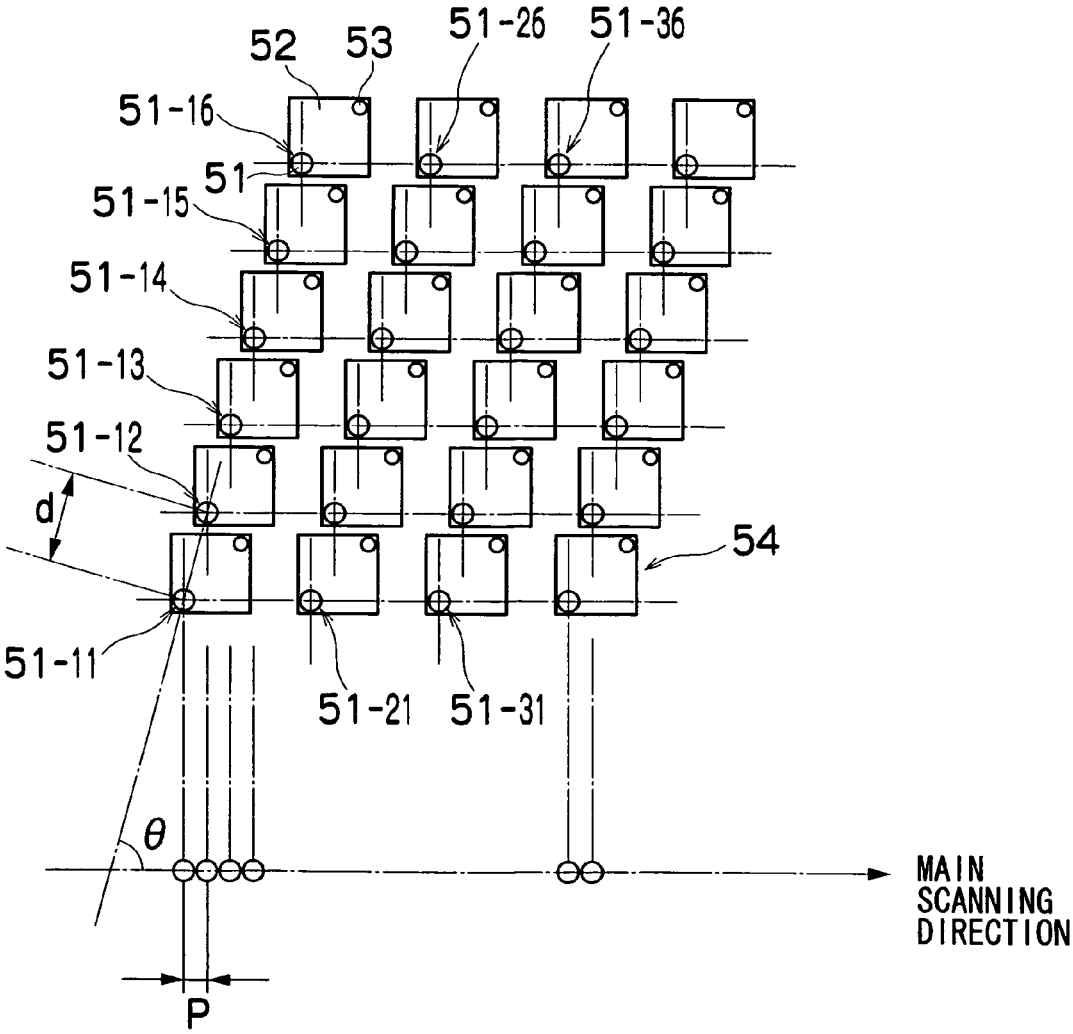
FIG. 6 is an enlarged view showing an example of the nozzle arrangement in the print head shown in FIG. 5.
Figure 7:
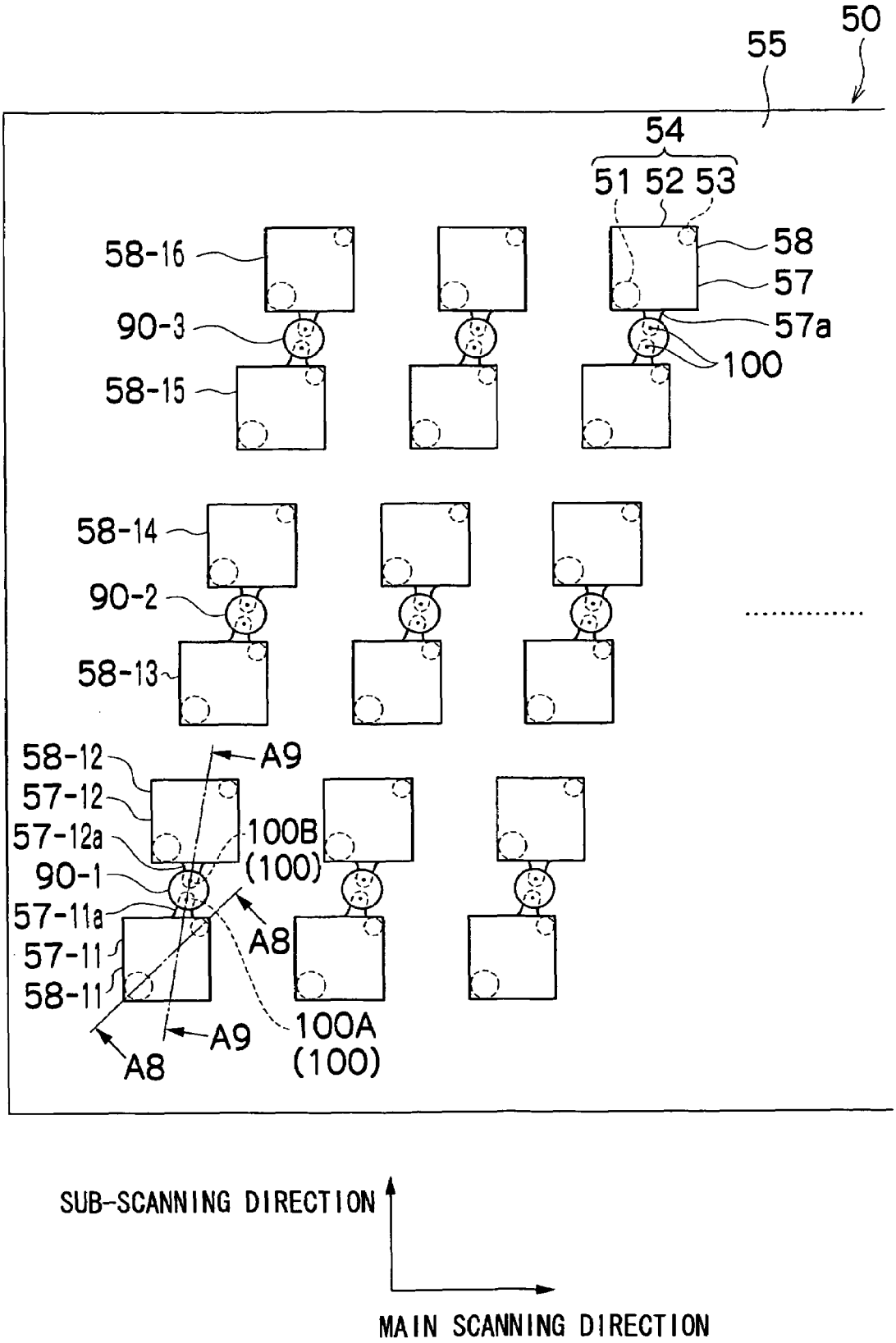
FIG. 7 is an enlarged detailed view showing a detailed section of the print head shown in FIG. 5.

Next, the structure of a print head 50 will be described. FIG. 5 is a plan view perspective diagram showing an example of the structure of a print head 50 according to the first embodiment of the present invention, and FIG. 6 is an enlarged diagram showing a nozzle arrangement in the print head 50 shown in FIG. 5. FIGS. 5 and 6 show an illustration in which the detailed section is omitted, for the convenience of the description, and this detailed section is depicted in FIG. 7, which is described hereinafter.

In order to achieve a high density of the dot pitch printed onto the surface of the recording medium, it is necessary to achieve a high density of the nozzle pitch in the print head 50. The print head 50 according to the present embodiment, as shown in FIG. 5, has a structure in which a plurality of pressure chamber units 54, each comprising a nozzle 51 for ejecting ink droplets, a pressure chamber 52 corresponding to the nozzle 51, and an ink supply port 53, are arranged in a staggered matrix, thereby achieving a high density of the nozzle pitch.

The pressure chamber 52 provided corresponding to each of the nozzles 51 is substantially square-shaped in plan view, and a nozzle 51 and an ink supply port 53 are provided respectively at either corner of a diagonal of the pressure chamber 52.

As shown in FIG. 6, the plurality of ink chamber units 54 are disposed in a lattice arrangement, based on a fixed arrangement pattern having a row direction which coincides with the main scanning direction, and a column direction which is inclined at a fixed angle of θ with respect to the main scanning direction, rather than being perpendicular to the main scanning direction. By adopting a structure in which a plurality of ink chamber units 54 are arranged at a uniform pitch d in a direction forming an angle θ with respect to the main scanning direction, the pitch P of the nozzles when projected to an alignment in the main scanning direction will be d×cos θ.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch).

In a full-line head comprising rows of nozzles that have a length corresponding to the entire width of the image recordable width, "main scanning" is defined as to print one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 6 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

FIG. 7 is an enlarged detailed view of a portion of the print head 50 shown in FIG. 5. As shown in FIG. 7, wiring members 90 are provided respectively between two piezoelectric elements 58 which are mutually adjacent in an oblique column direction which is not perpendicular to the main scanning direction. For example, wiring member 90-1 is disposed between piezoelectric element 58-11 and piezoelectric element 58-12, wiring member 90-2 is disposed between piezoelectric element 58-13 and piezoelectric element 58-14, and wiring member 90-3 is disposed between piezoelectric element 58-15 and piezoelectric element 58-16.

Figure 8:
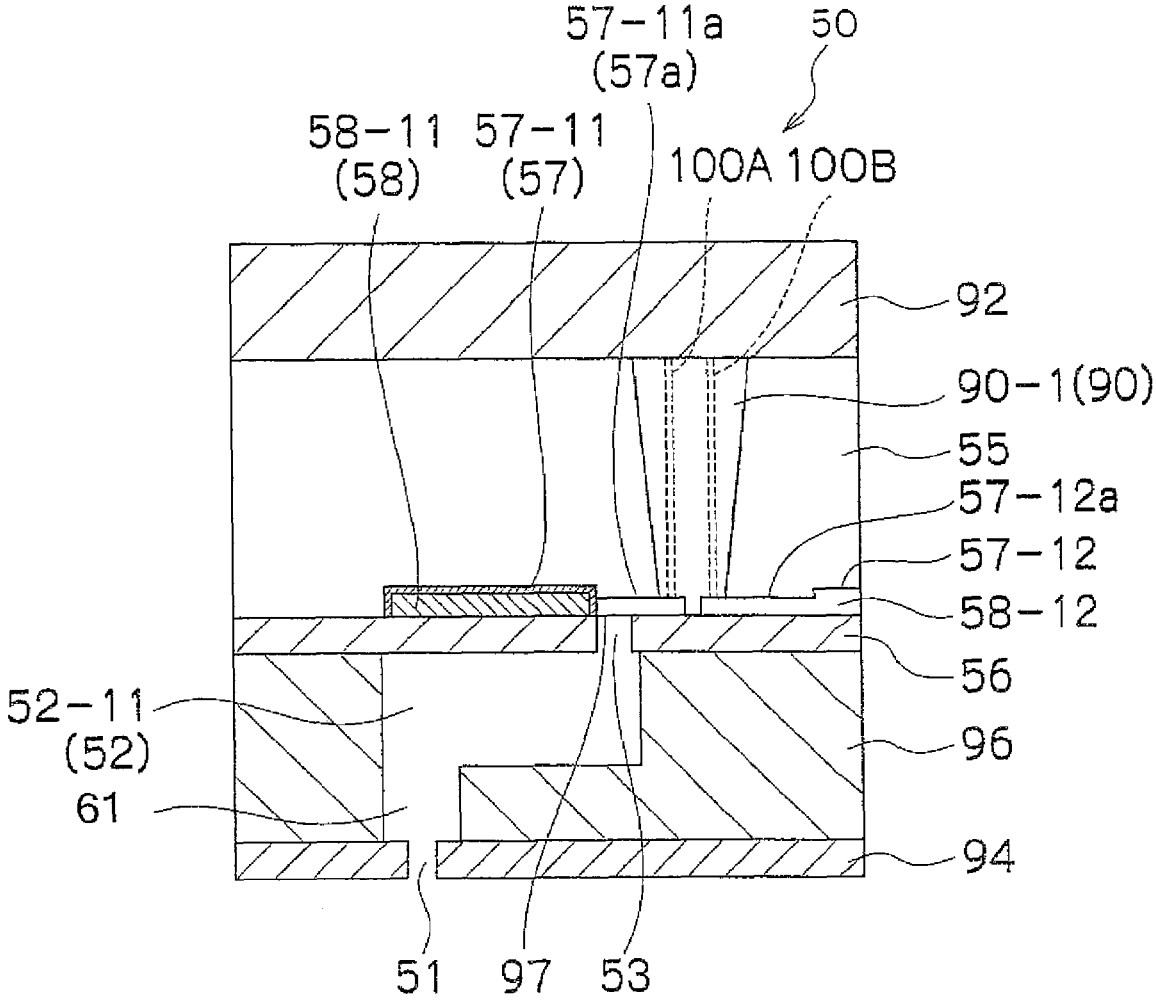
FIG. 8 is a cross-sectional diagram along line A8-A8 in FIG. 7.
Figure 9:
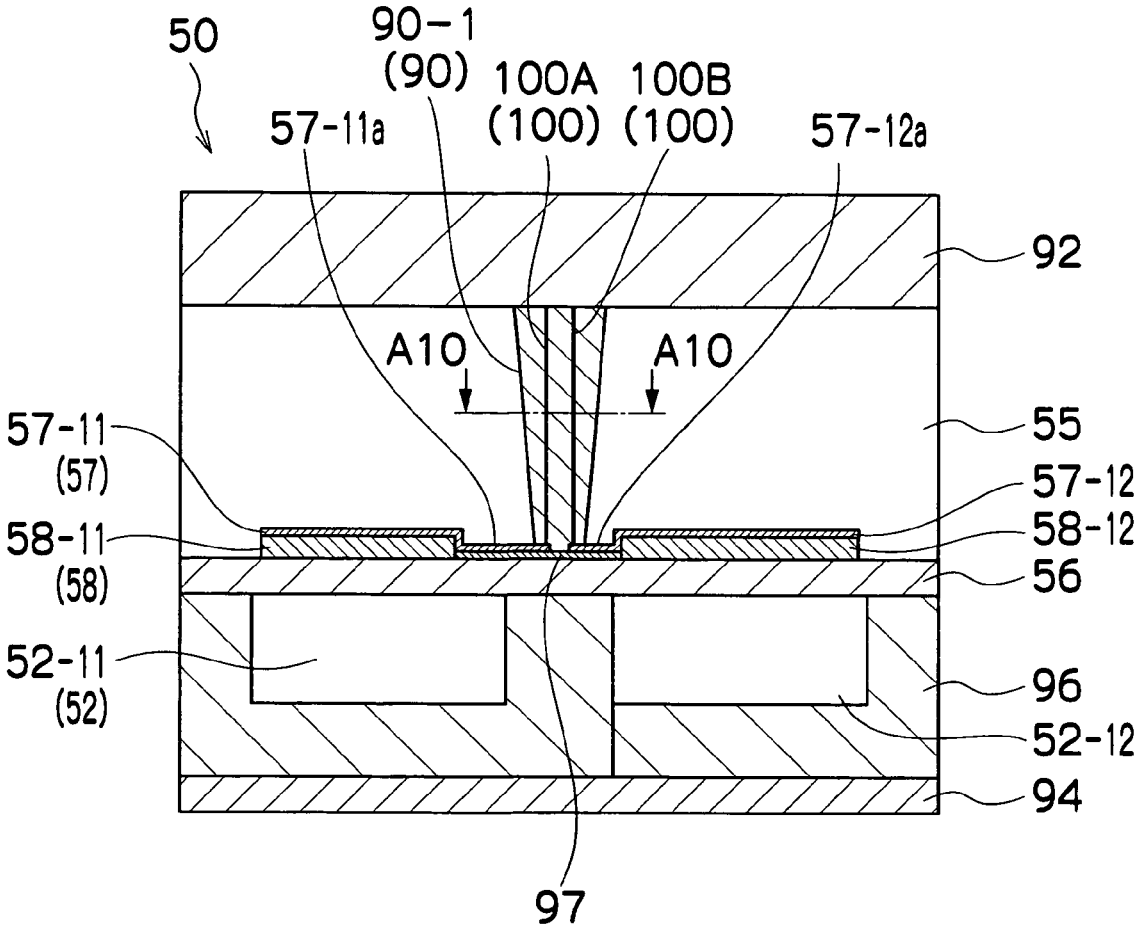
FIG. 9 is a cross-sectional diagram along line A9-A9 in FIG. 7.

FIG. 8 is a cross-sectional diagram along line A8-A8 in FIG. 7, and FIG. 9 is a cross-sectional diagram along line A9-A9 in FIG. 7.

As shown in FIG. 8 and FIG. 9, a nozzle plate 94 in which nozzles 51 are formed, a flow channel plate 96 in which pressure chambers 52 are formed, and a diaphragm 56 in which ink supply ports 53 are formed, are bonded together in a laminated fashion, and each pressure chamber 52 is connected to a common liquid chamber 55 disposed above the diaphragm 56, by means of an ink supply port 53.

Piezoelectric elements (piezoelectric actuators) 58 comprising individual electrodes 57 are bonded onto the diaphragm 56. The diaphragm 56 is made of an electrically conductive member, such as stainless steel, and it forms a common electrode for the piezoelectric elements 58.

Extending sections 57-11*a* and 57-12*a* are formed respectively on the individual electrodes 57-11 and 57-12, and a tapered column-shaped wiring member 90-1 is provided on top of the extending sections 57-11*a* and 57-12*a*. The wiring member 90-1 contains individual electrode wires 100A and 100B corresponding to the individual electrodes 57-11 and 57-12. The lower surface of the wiring member 90-1 is bonded by an anisotropically conductive adhesive, or the like, to the extending sections 57-11*a* and 57-12*a* of the individual electrodes 57-11 and 57-12. A non-conducting layer 97 is formed between the extending sections 57-11*a* and 57-12*a* of the individual electrodes 57-11 and 57-12, and the common electrode (diaphragm) 56, thereby ensuring the insulating properties between the individual electrodes 57-11 and 57-12, and the common electrode 56.

Furthermore, the frame of the print head 50 which makes contact with the end section of the diaphragm 56 functions as a common electrode wire (ground wire) to the common electrode (diaphragm) 56.

The upper surface of the wiring member 90-1 is bonded to a flexible cable 92. The flexible cable 92 is connected to the head driver 84 (see FIG. 4), and the drive signal sent from the head driver 84 is supplied to the individual electrode 57 via the wiring member 90-1.

The wiring members 90 are composed in such a manner that they rise up in a substantially perpendicular direction with respect to the surface of the piezoelectric elements 58, in the form of columns which pass through the ink accumulated in the common liquid chamber 55. Therefore, due to their shape and function, the wiring members 90 may also be called "electrical columns". The portions which are wetted by the ink, in the wiring members 90, the diaphragm 56 forming a face of the common liquid chamber 55, the piezoelectric elements 58, and the flexible cable 92, are formed with an insulating/protective film (not shown).

Next, the action of the print head 50 composed in this fashion will be described with reference to FIG. 7 to FIG. 9.

The ink accumulated in the common liquid chamber 55 is supplied to the pressure chamber 52, via the ink supply port 53. When the head driver 84 (see FIG. 4) sends a drive signal to the piezoelectric element 58, that drive signal is supplied to the individual electrode 57 via the flexible cable 92 and the wiring member 90. Accordingly, the piezoelectric element 58 deforms, and the diaphragm 56 constituting the ceiling of the pressure chamber 52 is caused to deform. Therefore, the volume of the pressure chamber 52 decreases, and the ink accumulated inside the pressure chamber 52 is ejected via the nozzle flow channel 61 and out from the nozzle 51, in the form of an ink droplet. When an ink droplet is ejected, new ink is supplied to the pressure chamber 52 from the common flow chamber 55, via the ink supply port 53.

In the print head 50 shown in FIG. 7 to FIG. 9, a common liquid chamber 55 is provided on the side of the pressure chambers 52 opposite to the side where the nozzles 51 are formed, and wiring members 90 which internally contain individual electrode wires 100 for the individual electrodes 57 are provided in such a manner that they pass through the common liquid chamber 55. Therefore, it is possible readily to ensure space for the electrical wiring, such as the flexible cable 92, or the like, which is connected to the head driver 84 (see FIG. 4), or the like, and consequently, it is possible to adapt to increase in the electrical wiring due to increase in the density of the nozzles 51.

Furthermore, by arranging the common liquid chamber 55 as described above, it is possible to form the common liquid chamber 55 to a larger size compared to a case where it is disposed on the same side of the pressure chambers 52 as the side where the nozzles 51 are formed. Furthermore, the length of the nozzle flow channel 61 between the pressure chamber 52 and the nozzle 51 can be shortened compared to a case where the common liquid chamber 55 is disposed on the same side of the pressure chambers 52 as the side where the nozzles 51 are formed. Moreover, it is also possible to construct direct flow channels for leading the ink from the common liquid chamber 55 to the pressure chambers 52, and complicated flow channels are not necessary.

Consequently, it is possible to eject high-viscosity ink (for example, ink having a viscosity of approximately 20 cP to 50 cP). Furthermore, it is also possible to perform rapid refilling of ink after ejection, and therefore, high-frequency driving becomes possible.

There are no particular restrictions on the size of the print head 50 described above, but to give one example, the planar shape of the pressure chambers 52 is a square shape of 300 μm×300 μm, and the height of the pressure chambers is 150 μm, while the diaphragm 56 and the piezoelectric elements 58 each have a thickness of 10 μm, and the wiring members 90 have a diameter of 100 μm at the bonding section with the individual electrodes 57, and a height of 500 μm.

Figure 10:
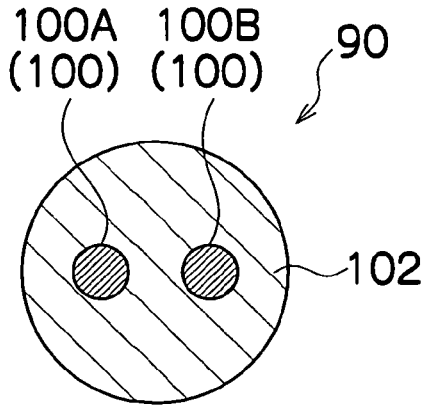
FIG. 10 is a cross-sectional diagram along line A10-A10 in FIG. 9.

FIG. 10 is a cross-sectional diagram along line A10-A10 in FIG. 9. As shown in this diagram, a wiring member 90 having a planar shape which is substantially circular in cross-section is constituted by individual electrode wires 100A and 100B which are substantially circular in cross-section, formed from conductors of solder, Al, Cu, Ni, or the like, and an insulating section 102 made of epoxy resin, an insulating resin coating, or the like.

A wiring member 90 of this kind is formed by opening holes in resin by means of laser processing or dry etching, and then either introducing a conductor into the holes, or carrying out plating.

The planar shape of the wiring member 90 and the individual electrode wires 100 is not limited to the substantially circular shape shown in FIG. 10, and it may also be a substantially square shape or a substantially elliptical shape, or the like. For example, the planar shape of the wiring member 90 may be formed into a substantially square shape, as in the modification example of the wiring member 90 shown in FIGS. 11A and 11B.

Figure 11A:
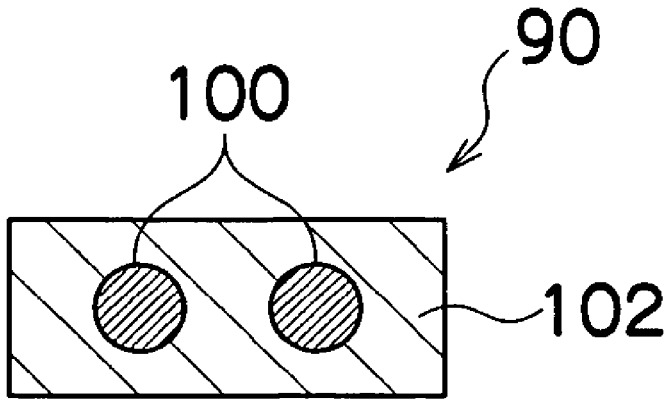
FIGS. 11A and 11B show a modification example of the wiring member shown in FIG. 10.

The wiring member 90 shown in FIG. 11A has substantially circular-shaped individual electrode wires 100, similarly to the wiring member 90 shown in FIG. 10. On the other hand, the wiring member 90 shown in FIG. 11B has substantially square-shaped individual electrode wires 100.

Figure 11B:
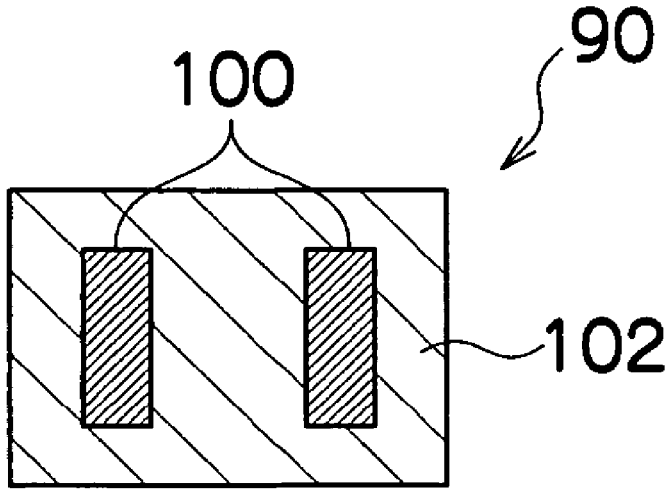

Furthermore, the individual electrode wires 100 provided inside the wiring member 90 are not limited to two in number, as shown in FIG. 10 and FIGS. 11A and 11B, and they may be three or more in number.

FIG. 12 to FIG. 19 (excluding FIG. 13 to FIG. 15B) are plan view perspective diagrams showing a partial enlargement of a print head 50 illustrating a modification example of a wiring member 90 according to the first embodiment of the present invention. In FIG. 12 to FIG. 19 (excluding FIG. 13 to FIGS. 15A and 15B), the extending sections 57*a* of the individual electrodes 57 are shown in simplified form by means of solid lines.

Figure 12:
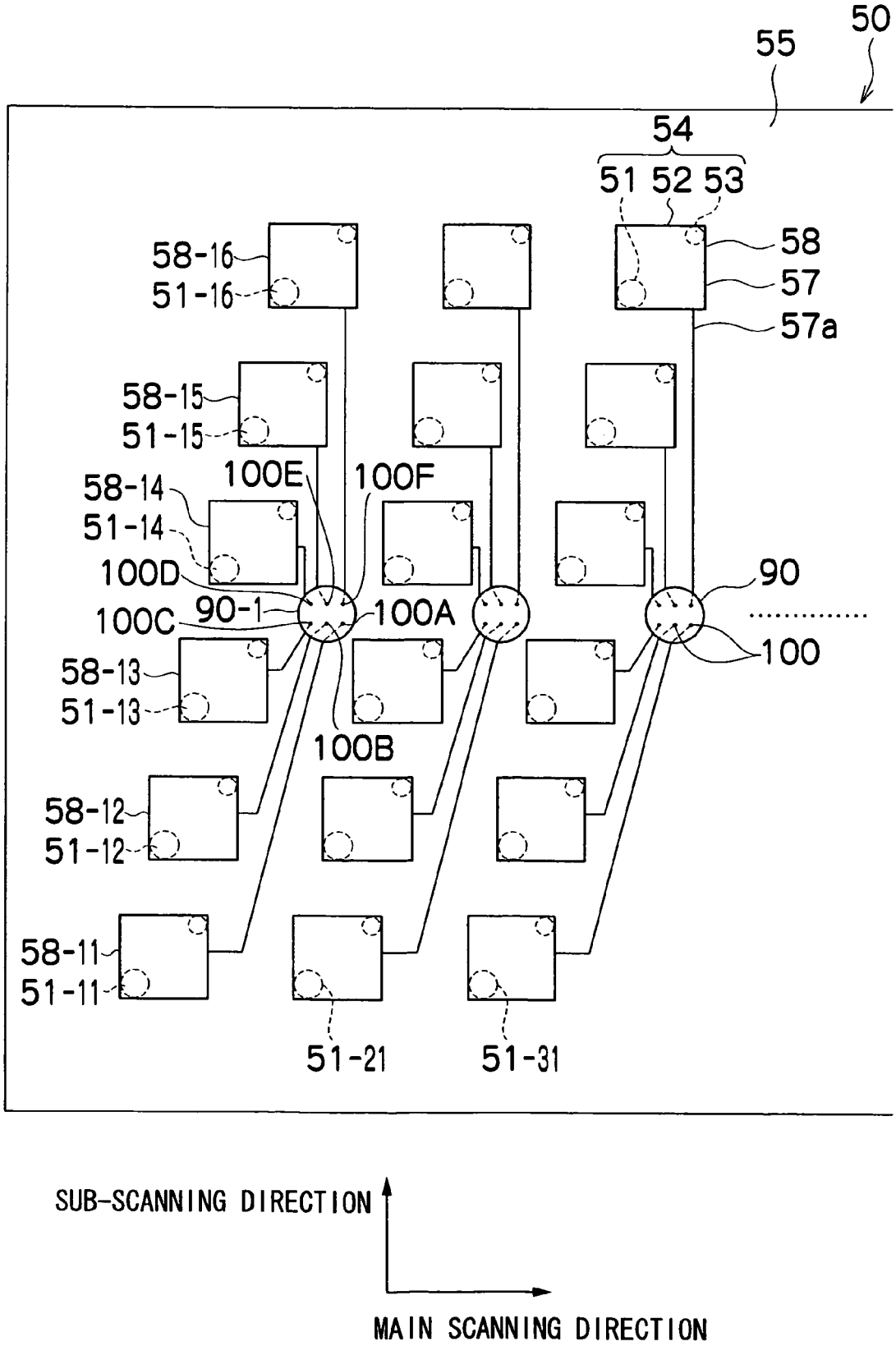
FIG. 12 is a plan view perspective diagram showing a partial enlargement of a print head illustrating a modification example of the wiring member.

In the print head 50 shown in FIG. 12, one wiring member 90 is provided with respect to all of the piezoelectric elements 58 arranged in an oblique column direction which is not perpendicular to the main scanning direction, in other words, the six piezoelectric elements 58 (58-11, 58-12, 58-13, 58-14, 58-15 and 58-16). For example, individual electrode wires 100A, 100B, 100C, 100D, 100E and 100F corresponding to the piezoelectric elements arranged in the column direction, 58-11, 58-12, 58-13, 58-14, 58-15 and 58-16, are provided inside the wiring member 90-1.

The nozzles 51-11, 51-12, 51-13, 51-14, 51-15 and 51-16 arranged in an oblique column direction which is not perpendicular to the main scanning direction constitute one block which is driven sequentially in accordance with the conveyance speed of the recording paper 16, as described with respect to FIG. 6. On the other hand, the nozzles 51-11, 51-21, 51-31, and so on, which are aligned in the main scanning direction, are driven simultaneously when forming one line in the width direction (main scanning direction) of the recording paper 16. Therefore, by adopting a composition in which the individual electrode wires 100 for piezoelectric elements 58 corresponding to a nozzle row aligned in the main scanning direction are not contained in the same wiring member 90, it is possible to reduce cross-talk between the wiring members 90, which include a plurality of individual electrode wires 100.

Figure 13:
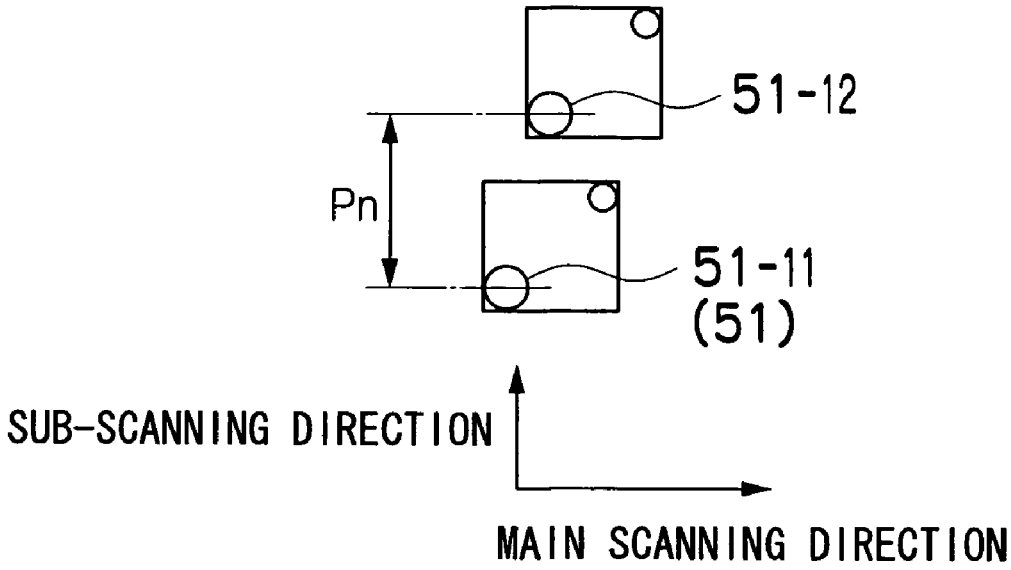
FIG. 13 is a partial enlarged view of a print head shown in FIG. 12.
Figure 14:
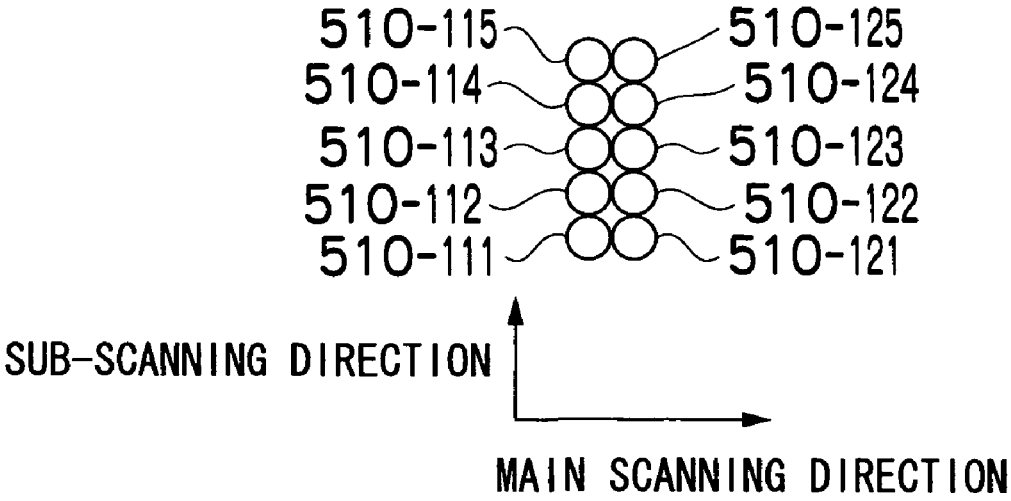
FIG. 14 is an illustrative diagram showing dots formed by droplets ejected onto the recording paper from the nozzles shown in FIG. 13.
Figure 15A:
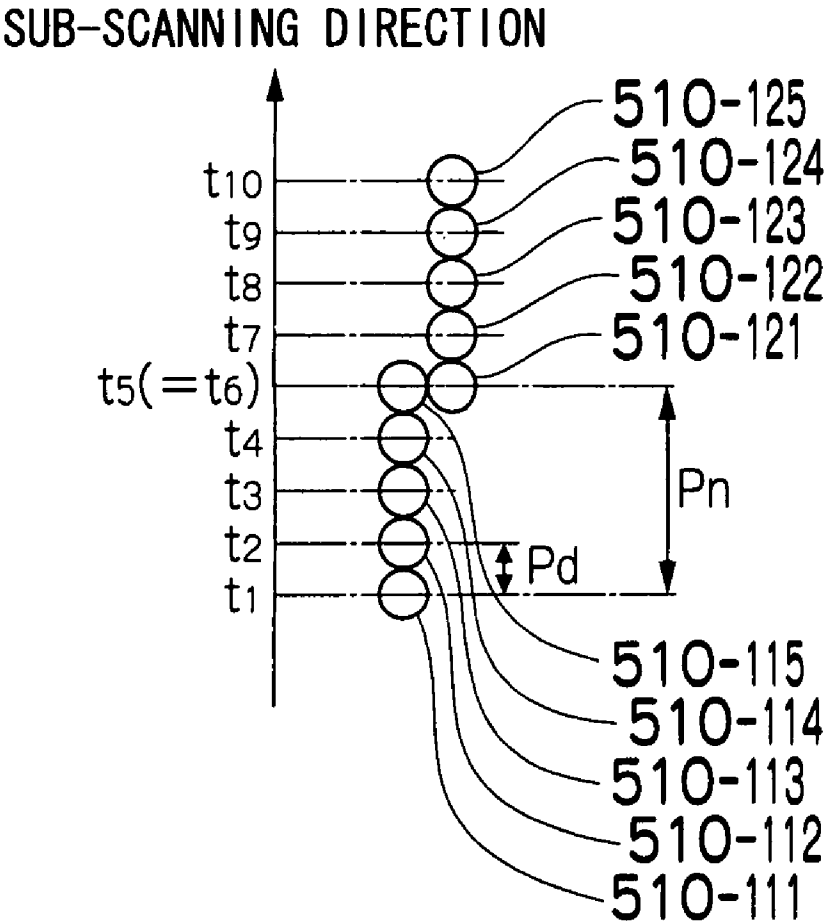
FIGS. 15A and 15B are illustrative diagrams showing the droplet ejection timing of the nozzles shown in FIG. 13.
Figure 15B:
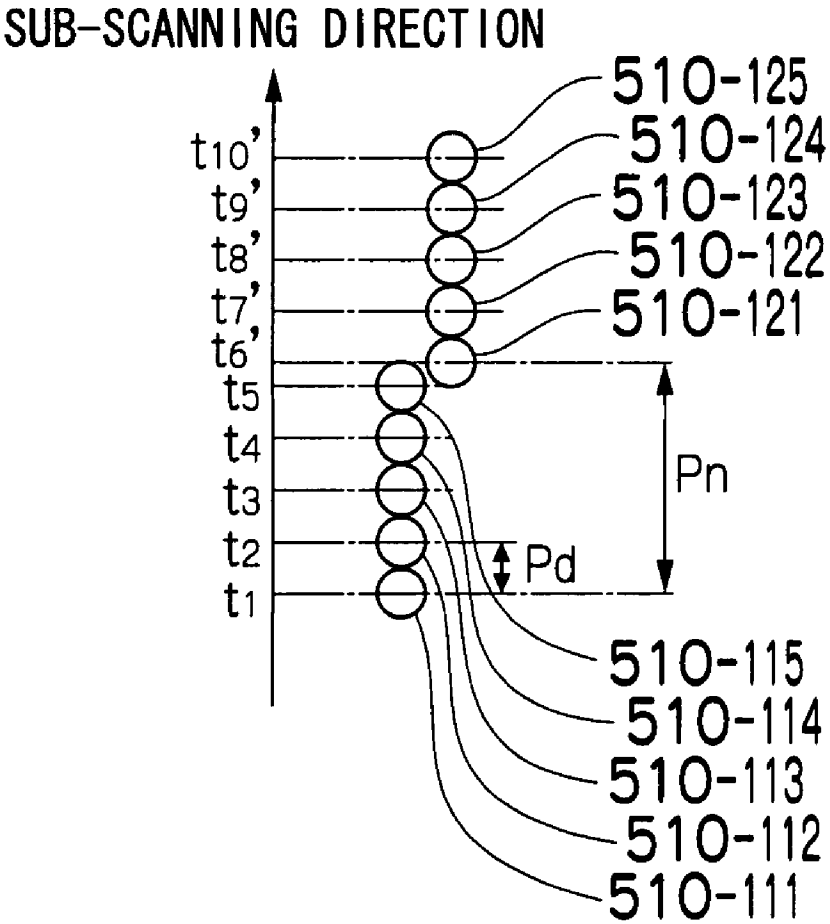

FIG. 13 is a partial enlarged view of the print head 50 shown in FIG. 12. FIG. 14 is an illustrative diagram showing dots formed by droplets ejected onto the recording paper 16 from the nozzles 51 shown in FIG. 13. FIGS. 15A and 15B are illustrative diagrams showing the droplet ejection timing of the nozzles 51 shown in FIG. 13.

As shown in FIG. 13, the nozzle pitch in the sub-scanning direction between the nozzles 51-11 and 51-12 is taken to be Pn, and as shown in FIG. 14, rows of two dots are formed in the main scanning direction of the recording paper 16, and columns of five dots are formed in the sub-scanning direction. Nozzle 51-11 ejects droplets to form the dots 510-111, . . . , 510-115 which are aligned in the sub-scanning direction, and nozzle 51-12 ejects droplets to form the dots 510-121, . . . , 510-125 which are aligned in the sub-scanning direction.

FIG. 15A shows the droplet ejection timing in a case where the nozzle pitch Pn is set to be an integral multiple of the dot pitch Pd in the sub-scanning direction on the recording paper 16 (in FIG. 15A, four times Pd). When droplets are ejected sequentially from nozzle 51-11 to form the five dots 510-111, . . . , 510-115 in accordance with the conveyance speed of the recording paper 16, at timing t6 which coincides with the last timing t5, a droplet is ejected from nozzle 51-12 to form dot 510-121. In other words, there is a timing at which the nozzle 51-11 and the nozzle 51-12 eject droplets simultaneously.

On the other hand, FIG. 15B shows the droplet ejection timing in a case where the nozzle pitch Pn is set so as not to be an integral multiple of the dot pitch Pd in the sub-scanning direction on the recording paper 16. At timing t5, a droplet is ejected from nozzle 51-11 only to form dot 510-115, and at timing t6', which is slightly delayed from timing t5, a droplet is ejected from nozzle 51-12 to form dot 510-121.

Consequently, in the print head 50 shown in FIG. 12, if a composition is adopted in which the nozzle pitch Pn in the sub-scanning direction is staggered so that it does not become an integral multiple of the dot pitch Pd in the sub-scanning direction on the recording paper 16, then the nozzles 51-11,

51-12, 51-13, 51-14, 51-15 and 51-16 aligned in an oblique column direction which is not perpendicular to the main scanning direction will not eject droplets simultaneously, and therefore, cross-talk in the wire member 90 containing the individual electrode wires 100 for the piezoelectric elements 58 corresponding to these nozzles, 51-11, . . . , 51-16 can be reduced.

In particular, in the present embodiment, desirably, the relationship between the nozzle pitch Pn in the sub-scanning direction and the dot pitch Pd in the sub-scanning direction on the recording paper 16 satisfies the following equation (1):

$$Pn=(n+k)\times Pd,$$

where n is a natural number, and k is a coefficient of $0.4 \leqq k \leqq 0.6$.

Figure 16:
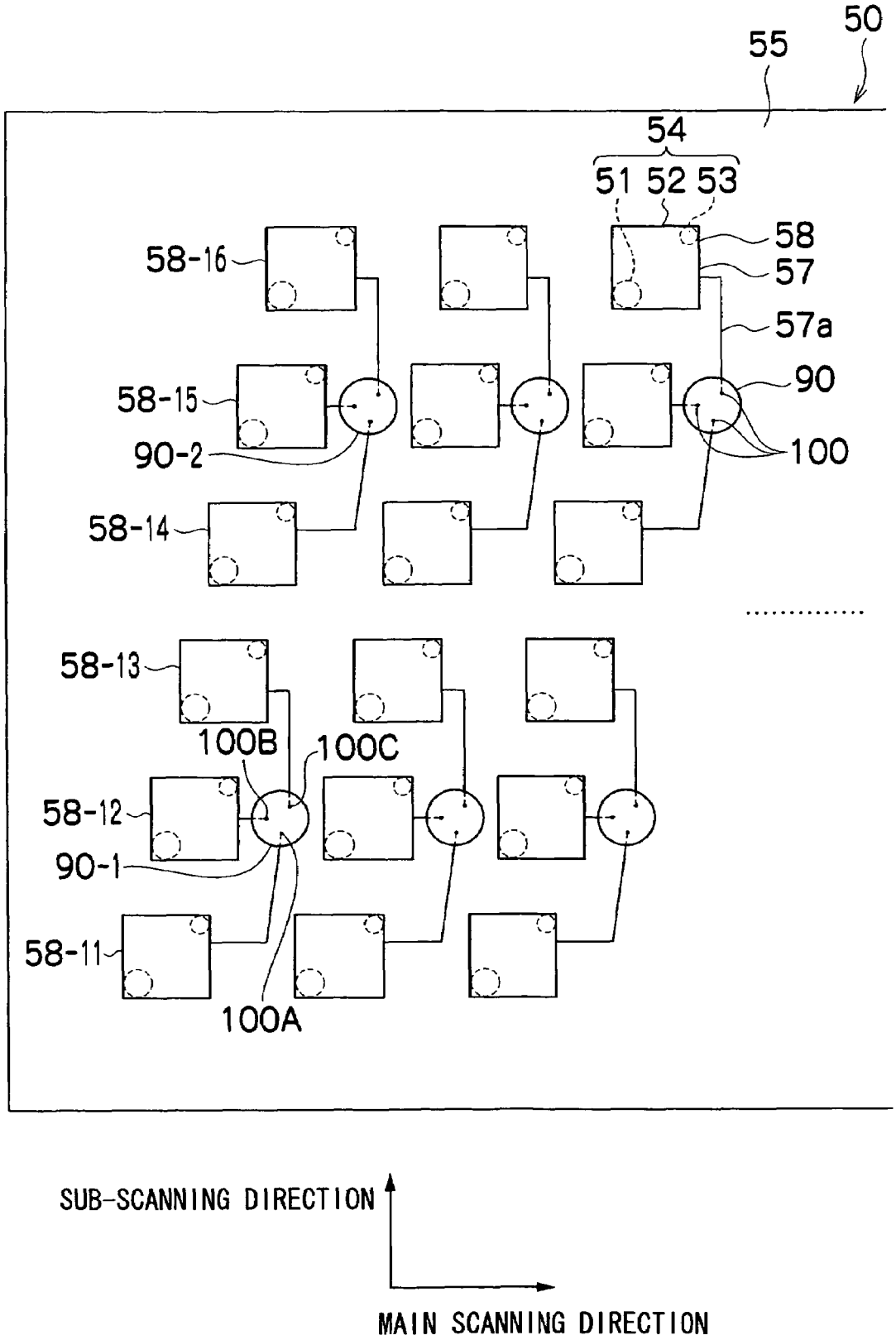
FIG. 16 is a plan view perspective diagram showing a partial enlargement of a print head illustrating a modification example of the wiring member.

In the print head 50 shown in FIG. 16, one wiring member 90 is provided respectively for each set of three piezoelectric elements 58 which are mutually adjacent in the oblique column direction which is not perpendicular to the main scanning direction. For example, individual electrode wires 100A, 100B and 100C corresponding to the piezoelectric elements 58-11, 58-12 and 58-13 are provided inside the wiring member 90-1. If the number of nozzles arranged in the column direction has risen as the density of the nozzles has been increased, then a composition may be adopted in which the individual electrode wires 100 of the piezoelectric elements 58 corresponding to a portion of these nozzles are incorporated into the wiring member 90, and in this case, similar effects to those shown in FIG. 12 are obtained and cross-talk in the wiring member 90 can be reduced.

Figure 17:
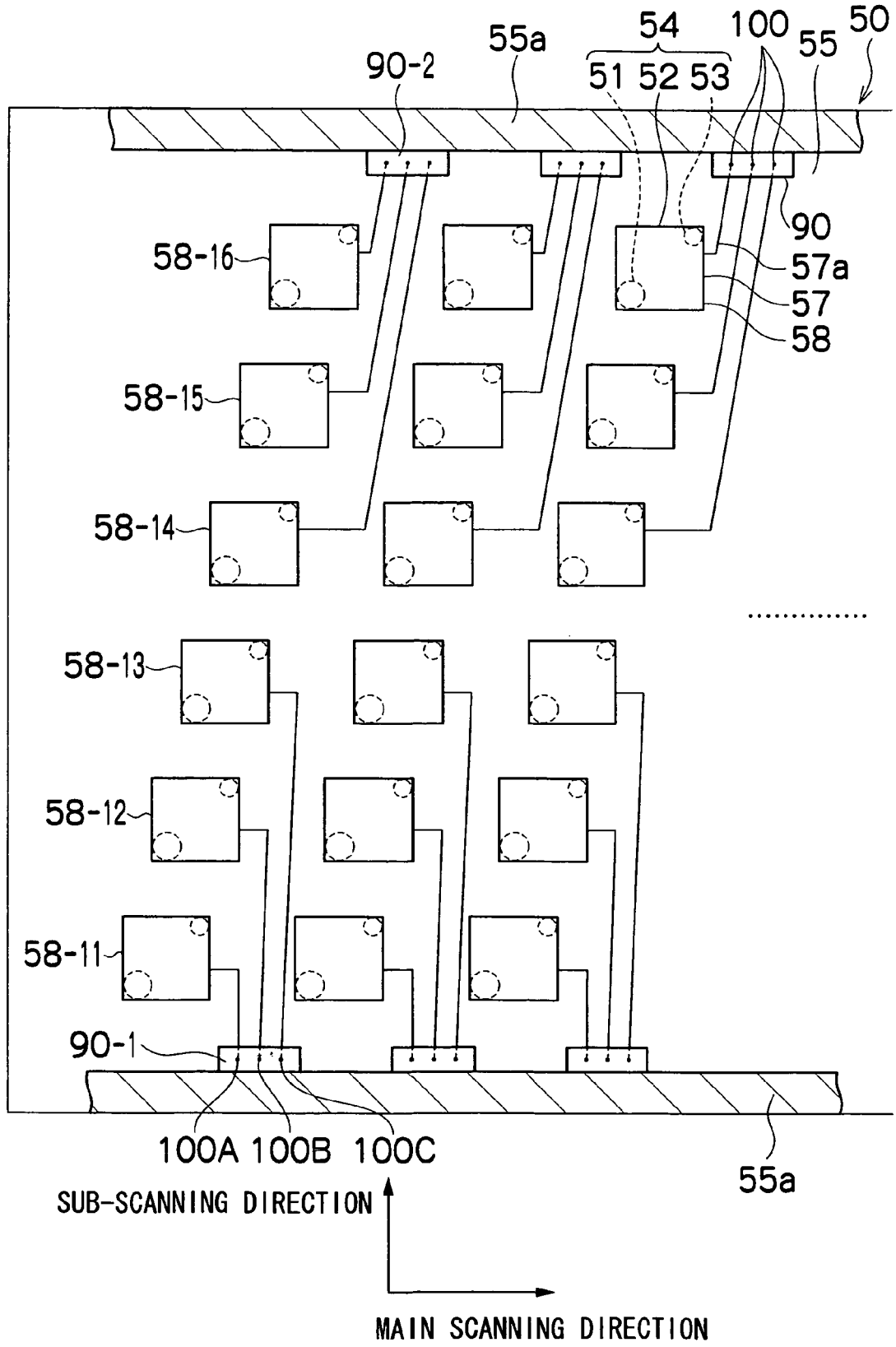
FIG. 17 is a plan view perspective diagram showing a partial enlargement of a print head illustrating a modification example of the wiring member.
Figure 18:
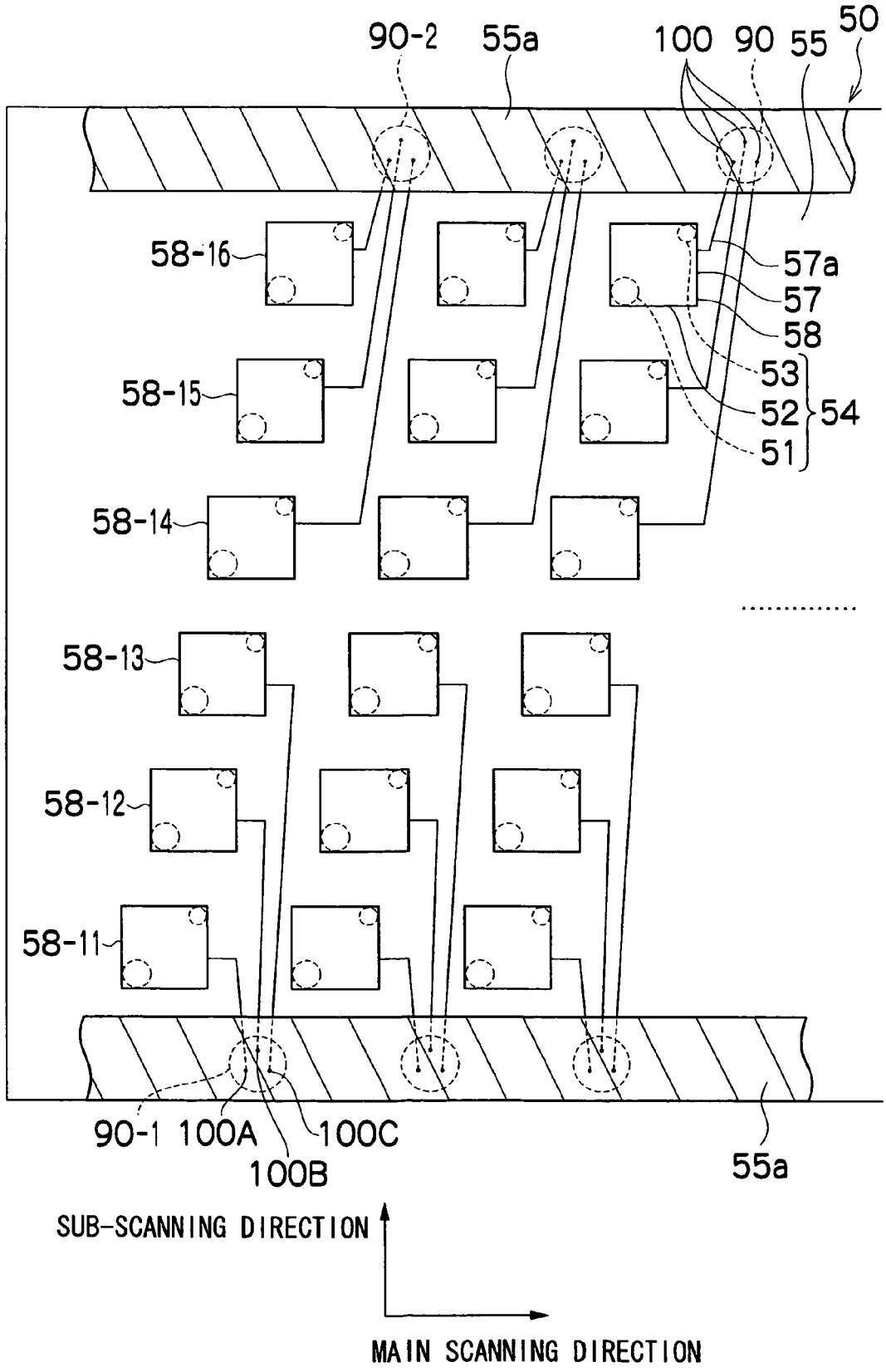
FIG. 18 is a plan view perspective diagram showing a partial enlargement of a print head illustrating a modification example of the wiring member.

In the print head 50 shown in FIG. 17, commonly with the compositional example shown in FIG. 16, one wiring member 90 is provided with respect to three piezoelectric elements 58 which are mutually adjacent in an oblique column direction which is not perpendicular to the main scanning direction, but the print head 50 in FIG. 17 differs in that the wiring members 90 are constructed in the form of walls, so as to make contact with the wall sections 55*a* of the common liquid chamber 55. Furthermore, in the print head 50 shown in FIG. 18, the wiring members 90 are provided in an integrated fashion, inside the wall sections 55*a* of the common liquid chamber 55.

Figure 19:
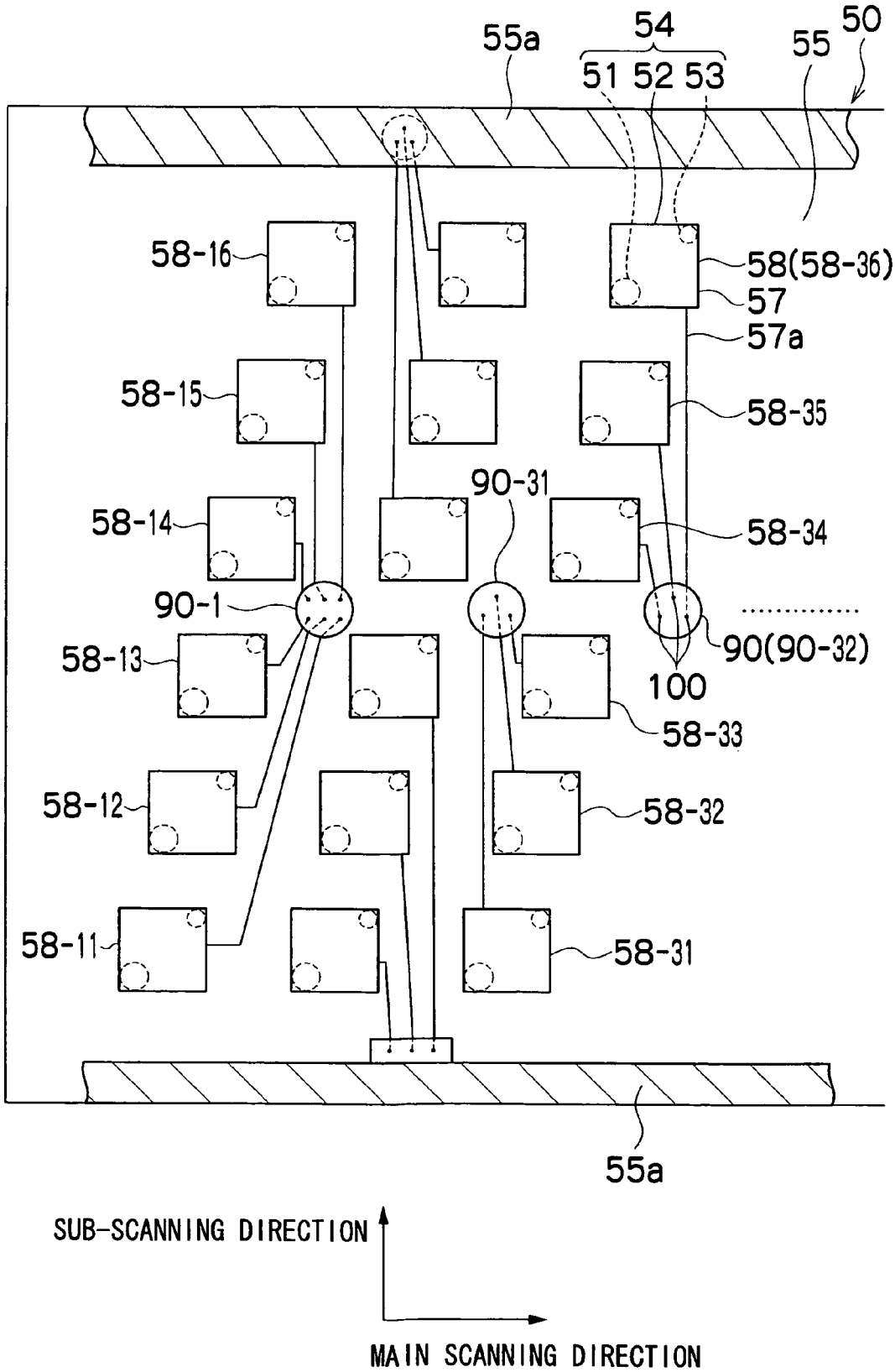
FIG. 19 is a plan view perspective diagram showing a partial enlargement of a print head illustrating a modification example of the wiring member.

The print head 50 shown in FIG. 19 is a combination of the compositional examples shown in FIG. 12 to FIG. 18 (excluding FIG. 13 to FIG. 15B). By changing the compositional pattern with respect to the oblique column direction which is not perpendicular to the main scanning direction, it is possible to arrange column-shaped and wall-shaped wiring members 90 inside the common liquid chamber 55.

The individual electrode wires 100 of the piezoelectric elements 58-31, . . . , 58-33 corresponding to a portion of the block constituted by the nozzles 51-31, . . . , 51-36 are contained in the wiring member 90-31, and the individual electrode wires 100 for the other piezoelectric elements 58-34, 58-35 and 58-36 belonging to that block are contained in the wiring member 90-32. Desirably, the individual electrode wires 90 for the piezoelectric elements 58 corresponding to nozzles 51 which belong to the same block in this way should be positioned closely to each other. The effects of cross-talk between the wiring member 90-31 and the wiring member 90-32 are small, and the flow channel resistance with respect to the ink inside the common liquid chamber 55 can be reduced.

By incorporating at least two individual electrode wires 100 inside a wiring member 90 in this way, the number of wiring members 90 provided in the print head 50 is reduced in comparison with a case where only one individual electrode wire 100 is contained in each wiring member 90, and therefore, the ratio of the space of the common liquid chamber 55 occupied by the column-shaped wiring members 100 is reduced. Consequently, ink refilling characteristics are improved. Furthermore, since stagnation points which may cause an obstruction to the ink flow are not liable to occur, then ink flow inside the common liquid chamber 55 is good, and performance in expelling air bubbles which may have infiltrated into the common liquid chamber 55 is also improved. As a result, even if the ink used in the print head 50 is ink of high viscosity, it is possible to achieve a steady supply of ink from the common liquid chamber 55 to the pressure chambers 52.

Since the wiring members 90 containing the plurality of individual electrode wires 100 have high rigidity compared to a wiring member 90 which contains only one individual electrode wire 100, then the wiring members 90 function as structural bodies. By forming a reinforcing material, or the like, onto the outer circumference of the wiring member 90, the rigidity of the wiring member 90 can be raised even further. Consequently, the rigidity of the pressure chambers 52 and the print head 50 as a whole is improved, and the print head 50 becomes less liable to deform in response to external stress.

Each of the wiring members 90 has a bonding section where it is bonded to the individual electrodes 57 using an adhesive, or the like. As stated previously, by including a plurality of individual electrode wires 100 in each wiring member 90, the number of wiring members 90 provided in the print head 50 is reduced, and therefore, the number of bonding sections is reduced. Consequently, the reliability of the bonding sections of the wiring members 90 in the whole print head 50 is improved.

Furthermore, desirably, a large number of the column-shaped wiring members 90 should be positioned in the vicinity of the approximate center region of the common liquid chamber 55, as shown in FIG. 12 and FIG. 19. Since the flow of ink is fast in the approximate center region of the common liquid chamber 55 and it is slow in the end regions, then by positioning a large number of column-shaped wiring members 90 in the vicinity of the approximate center region of the common liquid chamber 55, it is possible to achieve a uniform speed of the ink overall.

Figure 20A:
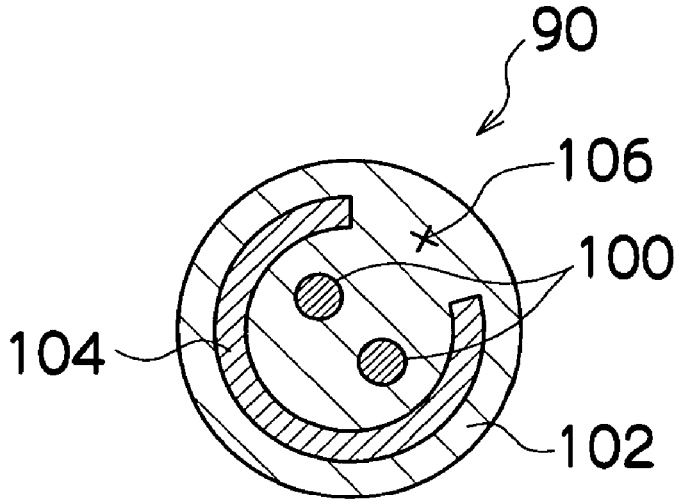
FIGS. 20A and 20B are illustrative diagrams showing an adaptive example of the wiring member.
Figure 20B:
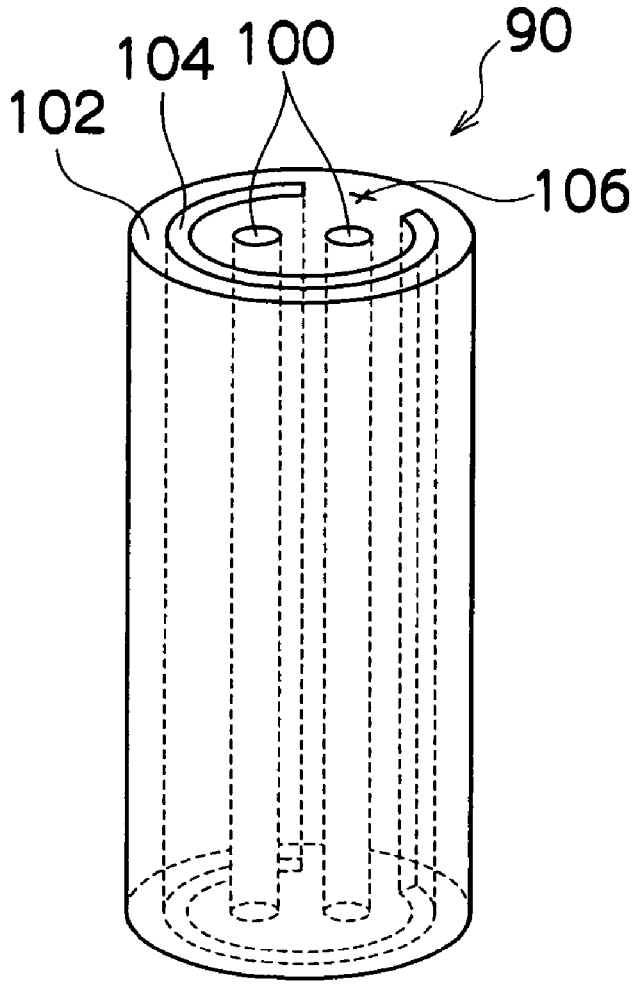

FIGS. 20A and 20B are illustrative diagrams showing an adaptive example of the wiring members 90 according to the first embodiment of the present invention. FIG. 20A is a horizontal cross-sectional diagram of a wiring member 90 and FIG. 20B is an oblique diagram of a wiring member 90.

As shown in FIG. 20A, a heater 104 having a C-shaped cross-section and a temperature sensor 106 are provided in the wiring member 90 which contains two individual electrode wires 100.

As shown in FIG. 20B, the heater 104 is provided in such a manner that it surrounds the two individual electrode wires 100 and spans between the upper surface and the lower surface of the wiring member 90. Therefore, it is possible to ensure a large surface area of the heater 104, and hence the temperature of the ink inside the common liquid chamber 55 can be adjusted efficiently.

Furthermore, since a heater 104 and a temperature sensor 106 are provided respectively in each wiring member 90, it is possible to adjust the temperature of the ink inside the common liquid chamber 55, locally, and therefore fine adjustment of the ink viscosity is possible.

Figure 21:
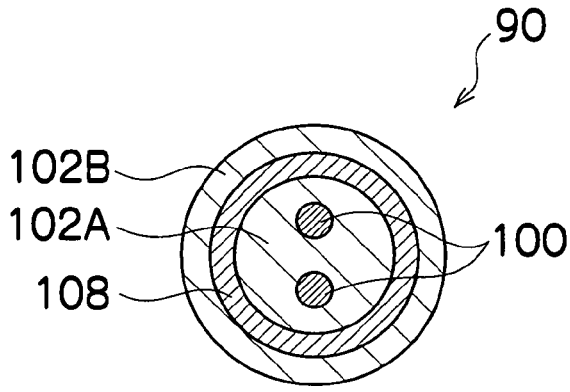
FIG. 21 is a horizontal cross-sectional diagram showing an example of the composition of wiring member according to a second embodiment of the present invention.

FIG. 21 is a horizontal cross-sectional diagram showing a compositional example of a wiring member 90 according to a second embodiment of the present invention. In the wiring member 90 shown in FIG. 21, a common electrode wire (ground wire) 108 having an approximately ring-shaped cross-section is provided in the approximate center region, in such a manner that surrounds two individual electrode wires 100.

Insulating sections 102A and 102B are provided respectively between the common electrode wire 108 and the individual electrode wire 100, to the outer side of the common electrode wire 108.

In this wiring member 90 in which a common electrode wire 108 of approximately ring-shaped cross-section is disposed so as to surround the individual electrode wires 100, shielding characteristics are good and noise resistance is also improved.

Furthermore, since the elasticity of the common electrode wire 108 is high compared to the elasticity of the insulating sections 102A and 102B, then the strength of the wiring member 90 is increased in comparison with the first embodiment, and the rigidity of the print head 50 is improved.

Figure 22:
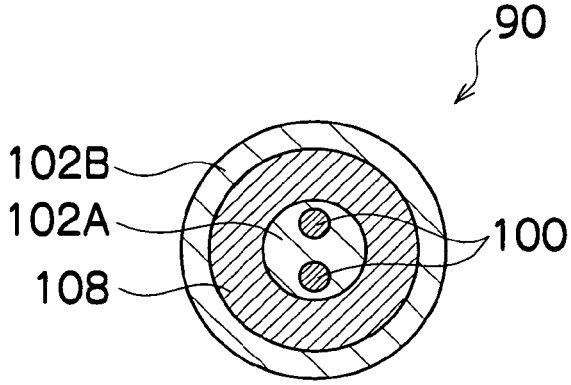
FIG. 22 shows a modification example of the wiring member shown in FIG. 21.

FIG. 22 is a modification example of a wiring member 90 shown in FIG. 21. In the wiring member 90 shown in FIG. 22, the thickness of the common electrode wire 108 is greater than that of the wiring member 90 shown in FIG. 21. Desirably, the ratio of the cross-sectional area of the common electrode wire 108 with respect to the cross-sectional area of the wiring member 90 is 50% or above. By reducing the thickness of the common electrode wire 108, the strength of the wiring member 90 is further improved.

Figure 23:
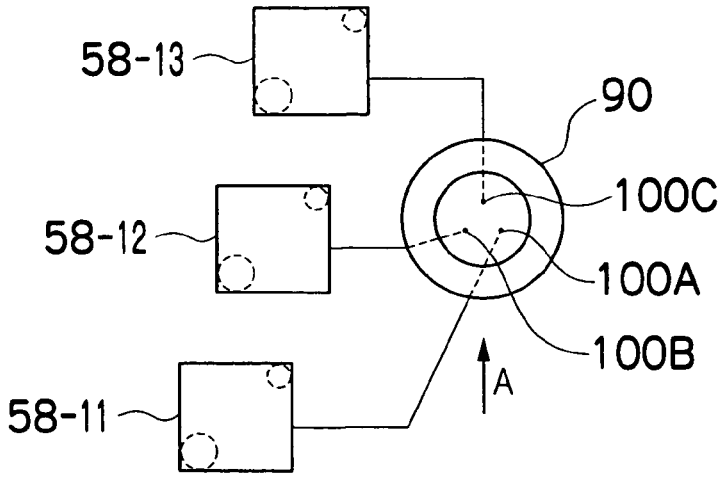
FIG. 23 is a plan view perspective diagram showing a partial enlargement of a print head illustrating a compositional example of a wiring member according to a third embodiment of the present invention.
Figure 24:
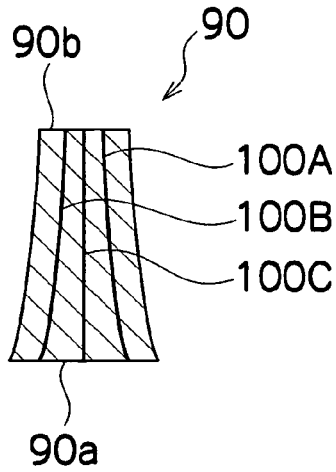
FIG. 24 is a perspective diagram of a cross-section in the direction of arrow A in the wiring member shown in FIG. 23.

FIG. 23 is a plan view perspective diagram showing a partial enlargement of a print head 50 illustrating a compositional example of a wiring member 90 according to the third embodiment of the present invention. FIG. 24 is a perspective diagram of cross-section in the direction of arrow A in the wiring member 90 shown in FIG. 23. As shown in FIG. 23, this embodiment is similar to the first embodiment in that one wiring member 90 is provided corresponding to the three piezoelectric elements 58-11, 58-12 and 58-13.

As shown in FIG. 24, the wiring member 90 according to the present embodiment is formed in a substantially circular conical shape, and the individual electrode wires 100A, 100B and 100C provided in the wiring member 90 are disposed in such a manner that the interval between the wires increases in the direction from the bonding surface 90*b* on the side by the flexible cable toward the bonding surface 90*a* on the side by the individual electrodes. More specifically, the wiring density of the wiring members 90 is lower at the bonding surface 90*a* on the side by the individual electrodes than at the bonding surface 90*b* on the side by the flexible cable.

By increasing the intervals between individual electrode wires 100A, 100B and 100C at the bonding surface 90*a* on the side by the piezoelectric elements, it is possible readily to achieve a reliable electrical connection between the piezoelectric elements 58-11, 58-12 and 58-13 and the individual electrode wires 100A, 100B and 100C.

Figure 25:
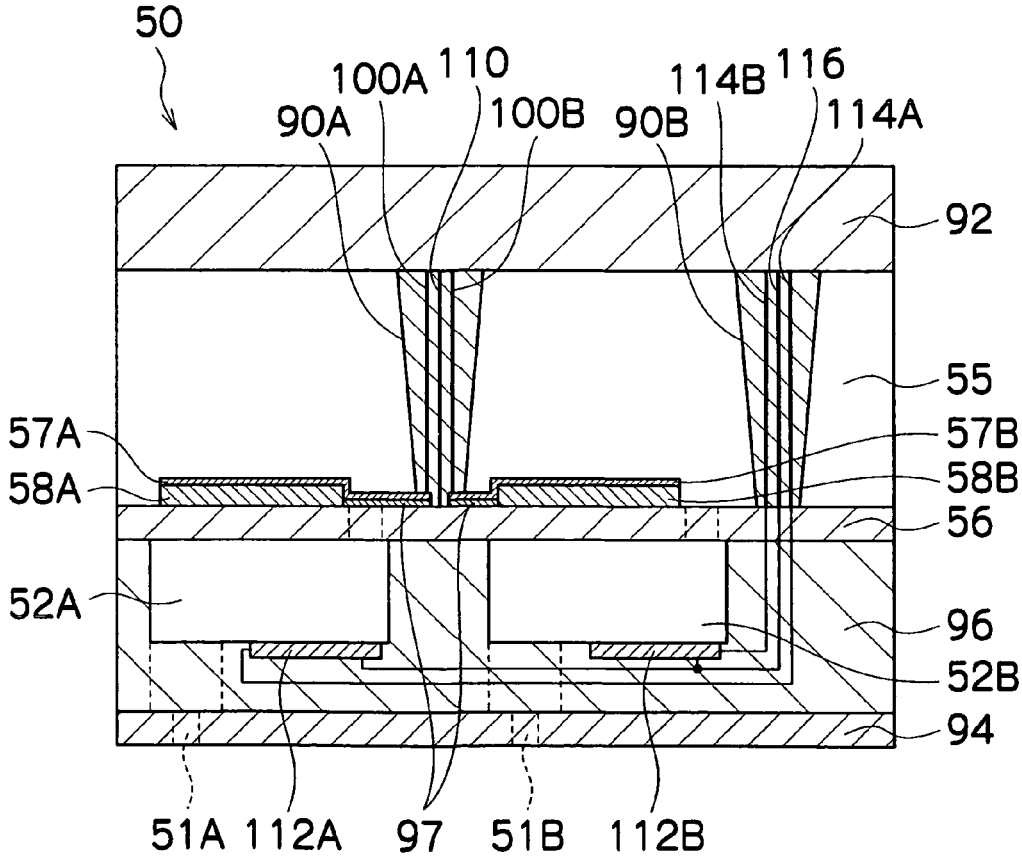
FIG. 25 is a partial cross-sectional diagram showing a print head illustrating a compositional example of a wiring member according to the fourth embodiment of the present invention.

FIG. 25 is a partial cross-sectional diagram showing a print head 50 illustrating a compositional example of a wiring member 90 according to the fourth embodiment of the present invention. The print head 50 shown in FIG. 25 comprises ejection failure sensors (pressure sensors) 112A and 112B provided respectively on the lower surface of the pressure chambers 52A and 52B in FIG. 25. The ejection failure sensors 112A and 112B are provided in order to determine infiltration of air bubbles, which may cause ejection defects of the nozzles 51A and 51B, into the pressure chambers 52A and 52B, and they measure the pressure applied to the ink stored in the pressure chambers 52A and 52B.

In the present embodiment, a composition is adopted in which the wires for the piezoelectric elements 58A and 58B and the wires for the ejection failure sensors 112A and 112B are contained in different wiring members 90A and 90B.

More specifically, the wiring member 90A comprises an individual electrode wire 100A for the individual electrode 57A of the piezoelectric element 58A, an individual electrode wire 100B for the individual electrode 57B of the piezoelectric element 58B, and a common electrode wire (ground wire) 110 for the common electrode (diaphragm) 56. On the other hand, the wiring member 90B comprises a signal wire 114A for the ejection failure sensor 112A, a signal wire 112B for the ejection failure sensor 112B and a common electrode wire (ground wire) 116 which is connected to the ejection failure sensors 112A and 112B.

By adopting a composition in which the wires for the piezoelectric elements 58A and 58B and the wires for the ejection failure sensors 112A and 112B are contained in different wiring members 90A and 90B, then it is possible to separate the noise of the piezoelectric elements 58A and 58B and the noise of the pressure sensors 112A and 112B, and therefore, it is possible to improve the S/N ratio of the pressure sensors 112A and 112B.

Figure 26:
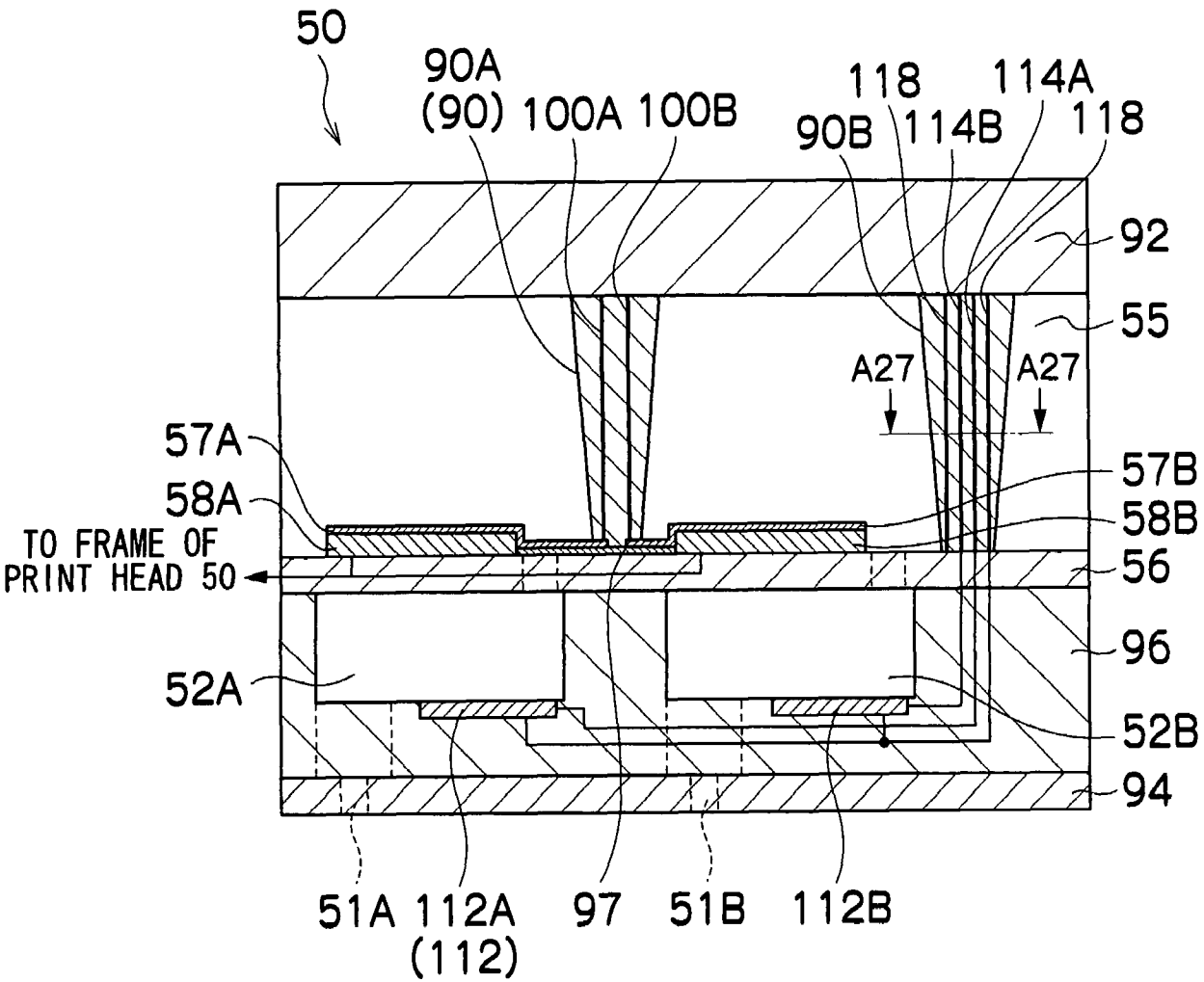
FIG. 26 is a partial cross-sectional side diagram of a print head showing a modification example of the wiring member.
Figure 27:
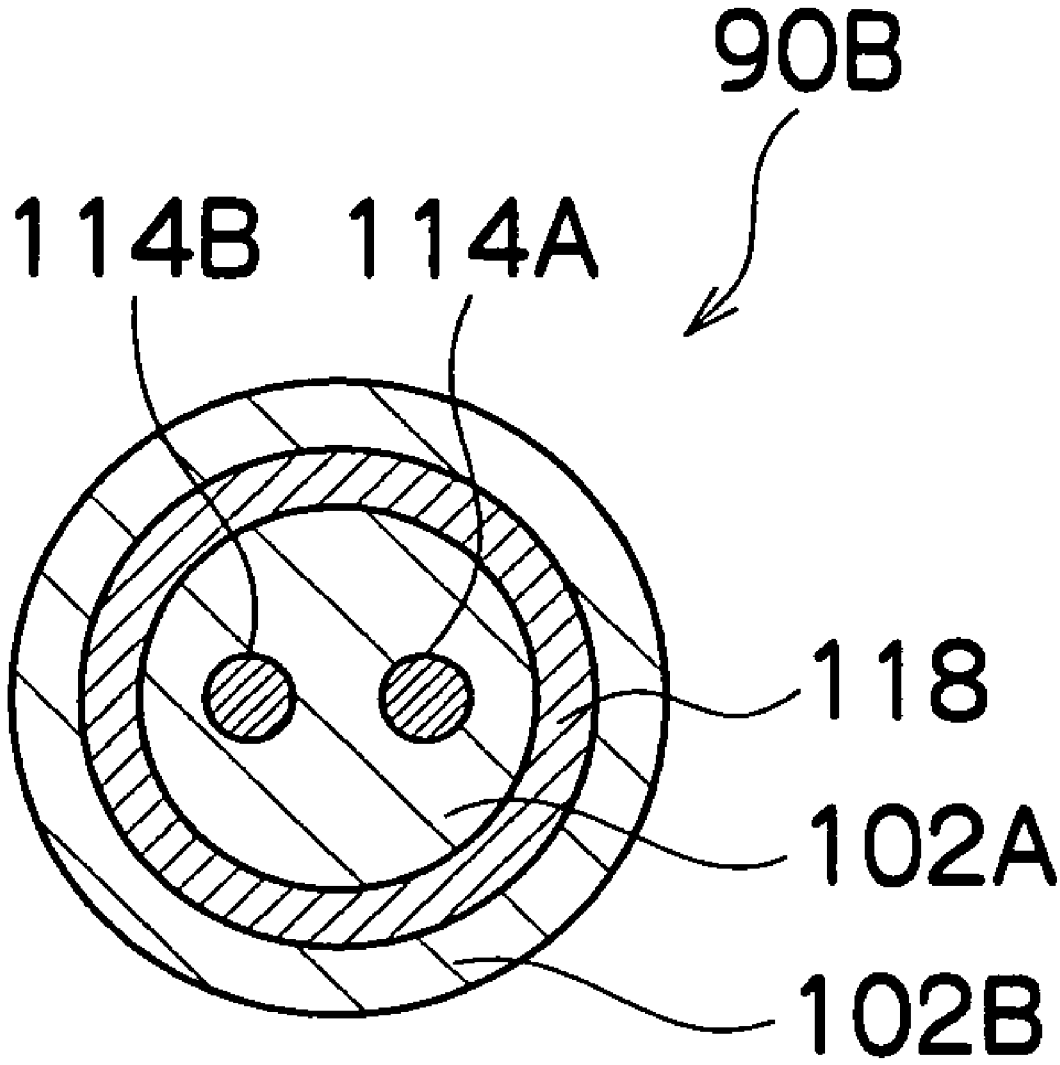
FIG. 27 is a cross-sectional diagram along line A27-A27 in FIG. 26.
Figure 28:
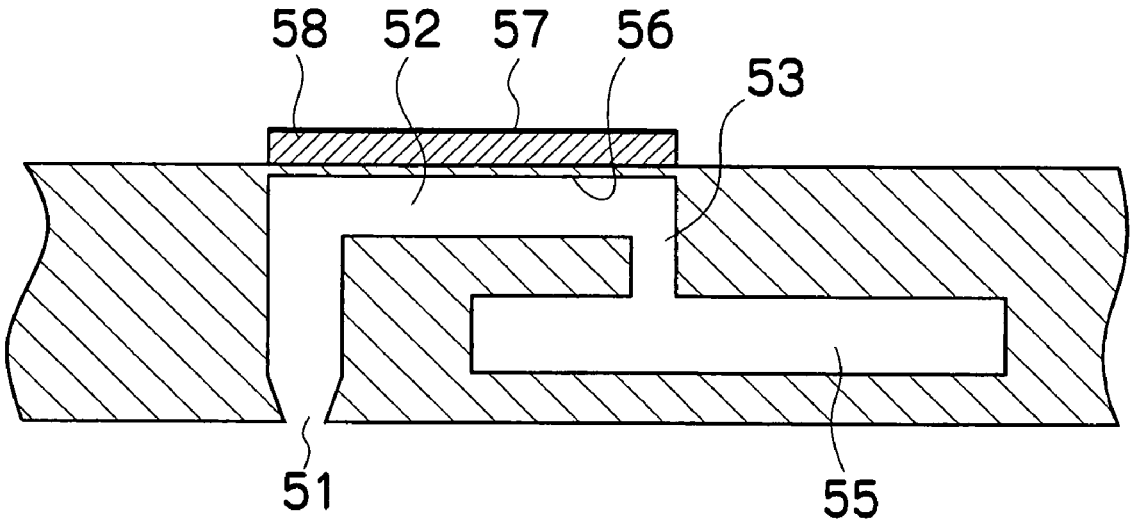
FIG. 28 is a cross-sectional side diagram showing part of the composition of a print head of the related art.

FIG. 26 is a partial cross-sectional side view of a print head 50 showing an example of a modification of the wiring member 90 shown in FIG. 25. FIG. 27 is a cross-sectional diagram along line A27-A27 in FIG. 26.

Similarly to the print head 50 shown in FIG. 25, the printhead 50 shown in FIG. 26 is composed in such a manner that the wires for the piezoelectric elements 58A and 58B and the wires for the ejection failure sensors 112A and 112B are contained in different wiring members 90A and 90B.

The wiring member 90A contains the individual electrode wire 100A for the individual electrode 57A of the piezoelectric element 58A and the individual electrode wire 100B of the individual electrode 57B of the piezoelectric element 58B, but it does not contain the common electrode wire 110 (see FIG. 25). The end sections of the common electrode (diaphragm) 56 and the frame of the print head 50 (not shown in FIG. 26) function as common electrode wiring for the common electrode 56.

On the other hand, the signal wire 114A for the ejection failure sensor 112A, the signal wire 114B for the ejection failure sensor 112B and the common electrode wire (ground wire) 118 connected to the ejection failure sensors 112A and 112B are contained in the wiring member 90B, similarly to FIG. 25.

As shown in FIG. 27, similarly to the second embodiment, the horizontal cross-sectional shape of the wiring member 90 has a dual shield structure in which signal wires 114A and 114B are disposed on the inner circumference portion of the common electrode wire 116 having a ring-shaped cross-section, and therefore, it is possible to improve the S/N ratio of the ejection failure sensors 112A and 112B.

Furthermore, similarly to FIG. 25, by arranging the common electrode wires for the piezoelectric elements 58A and 58B (the frame of the print head 50) and the common electrode wire 118 for the ejection failure sensors 112A and 112B, separately, it is possible to improve the S/N ratio of the ejection failure sensors 112A and 112B.

The liquid ejection head and the image forming apparatus according to the present invention have been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of ejection ports which eject liquid to a recording medium;

a plurality of pressure chambers which are connected respectively to the ejection ports and contain the liquid to be ejected through the ejection ports;

a plurality of piezoelectric elements which respectively deform the pressure chambers to eject the liquid contained in the pressure chambers through the ejection ports, the piezoelectric elements being provided on a side of the pressure chambers opposite to a side on which the ejection ports are formed;

a common liquid chamber which is connected to the pressure chambers and contains the liquid to be supplied to the pressure chambers, the common liquid chamber being provided on the side of the pressure chambers opposite to the side on which the ejection ports are formed; and a plurality of wiring members which are formed in such a manner that at least a portion thereof rises upward and passes through the common liquid chamber in a substantially perpendicular direction with respect to a surface on which the piezoelectric elements are disposed, each of the wiring members containing driving wires through which driving signals are applied respectively to at least two of the piezoelectric elements, and wherein the wiring members are formed in a shape of a column and are separate from an inner wall of the common liquid chamber which is perpendicular to the surface on which the piezoelectric elements are disposed.

2. The liquid ejection head as defined in claim 1, wherein the wiring members are formed so as to rise upward from the piezoelectric elements.

3. The liquid ejection head as defined in claim 1, wherein the wiring members are formed so as to rise upward from vicinities of the piezoelectric elements.

4. The liquid ejection head as defined in claim 1, wherein:

the ejection ports are arranged in a two-dimensional array; and the wiring members are arranged two-dimensionally on the surface on which the piezoelectric elements are disposed.

5. The liquid ejection head as defined in claim 4, wherein each of the wiring members contains the driving wires for the piezoelectric elements corresponding to at least two of the ejection ports arranged in a column direction having a prescribed non-perpendicular angle with respect to a width direction of the recording medium.

6. The liquid ejection head as defined in claim 5, wherein each of the wiring members contains the driving wires for the piezoelectric elements corresponding to all of the ejection ports arranged in the column direction.

7. The liquid ejection head as defined in claim 5, wherein:

$$Pn=(n+k)\times Pd,$$

where Pn is a pitch of the ejection ports in a sub-scanning direction substantially perpendicular to the width direction of the recording paper, Pd is a pitch of dots formed on the recording medium in the sub-scanning direction by droplets of the liquid ejected from the ejection ports, n is a natural number, and k is a coefficient of $0.4 \leqq k \leqq 0.6$.

8. An image forming apparatus, comprising the liquid ejection head as defined in claim 1.

9. The liquid ejection head as defined in claim 1, wherein the each of the wiring members containing driving wires through which driving signals are applied respectively to at least three of the piezoelectric elements.

10. The liquid ejection head as defined in claim 1, wherein the each of the wiring member containing driving wires through which driving signals are applied respectively to at least six of the piezoelectric elements.

11. The liquid ejection head as defined in claim 1, wherein each of the wiring members include a temperature sensor and a heater.

12. The liquid ejection head as defined in claim 1, wherein the wiring members each have a substantially circular cross-sectional shape in a direction parallel to the surface on which the piezoelectric elements are disposed.

13. A liquid ejection head, comprising:

a plurality of ejection ports which eject liquid to a recording medium;

a plurality of pressure chambers which are connected respectively to the ejection ports;

a plurality of piezoelectric elements which respectively deform the pressure chambers and are provided on a side of the pressure chambers opposite to a side on which the ejection ports are formed;

a common liquid chamber which is provided on the side of the pressure chambers opposite to the side on which the ejection ports are formed; and a plurality of wiring members which are formed in such a manner that at least a portion thereof rises upward through the common liquid chamber in a substantially perpendicular direction with respect to a surface on which the piezoelectric elements are disposed, each of the wiring members containing driving wires through which driving signals are applied respectively to at least two of the piezoelectric elements, wherein each of the wiring members comprises:

individual electrode wires for the piezoelectric elements, the individual electrode wires being arranged in substantially central region of the each of the wiring members; and a common electrode wire for the piezoelectric elements, the common electrode wire being formed so as to surround perimeters of the individual electrode wires.

14. A liquid ejection head, comprising:

a plurality of ejection ports which eject liquid to a recording medium;

a plurality of pressure chambers which are connected respectively to the ejection ports;

a plurality of piezoelectric elements which respectively deform the pressure chambers and are provided on a side of the pressure chambers opposite to a side on which the ejection ports are formed;

a common liquid chamber which is provided on the side of the pressure chambers opposite to the side on which the ejection ports are formed; and a plurality of wiring members which are formed in such a manner that at least a portion thereof rises upward through the common liquid chamber in a substantially perpendicular direction with respect to a surface on which the piezoelectric elements are disposed, each of the wiring members containing driving wires through which driving signals are applied respectively to at least two of the piezoelectric elements, wherein a wiring density per unit cross-sectional area inside the wiring members is lower on a side adjacent to the piezoelectric elements.

15. A liquid ejection head, comprising:

a plurality of ejection ports which eject liquid to a recording medium;

a plurality of pressure chambers which are connected respectively to the ejection ports and contain the liquid to be ejected through the ejection ports;

a plurality of piezoelectric elements which respectively deform the pressure chambers to eject the liquid contained in the pressure chambers through the ejection ports, the piezoelectric elements being provided on a side of the pressure chambers opposite to a side on which the ejection ports are formed;

a common liquid chamber which is connected to the pressure chambers and contains the liquid to be supplied to the pressure chambers, the common liquid chamber being provided on the side of the pressure chambers opposite to the side on which the ejection ports are formed;

a plurality of wiring members which are formed in such a manner that at least a portion thereof rises upward and passes through the common liquid chamber in a substantially perpendicular direction with respect to a surface on which the piezoelectric elements are disposed, each of the wiring members containing driving wires through which driving signals are applied respectively to at least two of the piezoelectric elements;

a plurality of determination devices which are provided with respect to the plurality of pressure chambers respectively and determine ejection failures at the ejection ports by determining pressure given to the liquid in the plurality of pressure chambers respectively; and a determination wiring member which is formed in such a manner that at least a portion thereof rises upward through the common liquid chamber in a substantially perpendicular direction with respect to the surface on which the piezoelectric elements are disposed, the determination wiring member containing determination wires through which determination signals of the determination devices are outputted.

* * * * *